US006247455B1

(12) United States Patent
Otake et al.

(10) Patent No.: US 6,247,455 B1
(45) Date of Patent: Jun. 19, 2001

(54) INJECTION QUANTITY CONTROL APPARATUS PROVIDED TO INTERNAL COMBUSTION ENGINE

(75) Inventors: Yukio Otake, Nagoya; Takashi Hayashi, Mishima, both of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/407,229

(22) Filed: Sep. 27, 1999

(30) Foreign Application Priority Data

Oct. 8, 1998 (JP) ..... 10-286830
Oct. 9, 1998 (JP) ..... 10-287960

(51) Int. Cl.[7] ..... F01D 17/00; F02M 69/54
(52) U.S. Cl. ..... 123/511; 123/435; 123/457
(58) Field of Search ..... 123/435, 445, 123/454, 457, 463, 510, 511; 261/64.3, 69.1

(56) References Cited

U.S. PATENT DOCUMENTS 3,963,809 * 6/1976 Steiner ..... 261/69.1
4,040,405 * 8/1977 Tanaka et al. ..... 123/457
4,091,783 * 5/1978 Laprade et al. ..... 123/587
4,217,869 * 8/1980 Masaki ..... 123/438
4,393,855 * 7/1983 Mandar et al. ..... 123/587
5,577,487 11/1996 Ohtake et al. ..... 123/679

OTHER PUBLICATIONS

"My Maintenance Note", Naoyuki Yokoyama, Japan Aeronautical Engineers' Association, Jul. 10, 1981.

* cited by examiner

*Primary Examiner*—Henry C. Yuen
*Assistant Examiner*—Hieu T. Vo
(74) *Attorney, Agent, or Firm*—Kenyon & Kenyon

(57) ABSTRACT

An injection quantity control apparatus provided to an internal combustion engine having an injection nozzle which continuously injects fuel is provided. The apparatus includes a fuel quantity adjustment mechanism which has a static pressure chamber and a total pressure chamber to which a static pressure and a total pressure of an intake pipe of said engine are supplied, respectively, and adjusts an amount of fuel supplied to said injection nozzle in accordance with a dynamic pressure between a pressure of said static pressure chamber and a pressure of said total pressure chamber. The apparatus also includes a dynamic pressure corrector which corrects said dynamic pressure so that an air-fuel ratio of the engine is controlled to be substantially a target value. Thus, a desired air-fuel ratio can be achieved without a necessity of a manual operation by an operator.

17 Claims, 23 Drawing Sheets

INJECTION QUANTITY CONTROL APPARATUS PROVIDED TO INTERNAL COMBUSTION ENGINE

BACKGROUND OF THE INVENTION

1. Field of the Invention

The present invention is related to an injection quantity control apparatus provided to an internal combustion engine, and in particular to an injection quantity control apparatus provided to an internal combustion engine in which fuel is continuously injected.

2. Description of the Related Art

Conventionally, as disclosed in "My Maintenance Note," Naoyuki Yokoyama, Japan Aeronautical Engineers' Association, Jul. 10, 1981), there is known an injection quantity control apparatus provided to an internal combustion engine for an aircraft. This control device includes a first chamber and a second chamber.

The first chamber is divided into a static pressure chamber and a total pressure chamber by a first diaphragm. A static pressure and a total pressure generated in an intake pipe of the engine are introduced into the static pressure chamber and the total pressure chamber, respectively. Thus, a dynamic pressure is generated between the static pressure chamber and the total pressure chamber in accordance with a specific volume of intake air. Hereinafter, this dynamic pressure is referred to as a first differential pressure. A force is exerted on the first diaphragm in accordance with the first differential pressure.

The second chamber is divided into a back pressure chamber and a fuel chamber by a second diaphragm. A valve mechanism is provided in the fuel chamber. Fuel is delivered from the fuel chamber through the valve mechanism. Thus, an amount of fuel delivered from the fuel chamber is adjusted in accordance with an opening of the valve mechanism. The fuel chamber is supplied with fuel which is pumped up by a fuel pump through a mixture valve. An opening of the mixture valve can be changed by a mixture lever being manually operated by an operator. When fuel is delivered from the fuel chamber through the valve mechanism, a fuel pressure in the fuel chamber is decreased from a discharge pressure of the fuel pump by a value corresponding to a pressure drop across the mixture valve. On the other hand, the back pressure chamber is directly supplied with fuel discharged by the fuel pump. Thus, between the back pressure chamber and the fuel chamber, there is generated a differential pressure in accordance with the pressure drop across the mixture valve, that is, a differential pressure in accordance with a product of a flow resistance of the mixture valve and an amount of delivered fuel. Hereinafter, this differential pressure is referred to as a second differential pressure. A force in accordance with the second differential pressure is exerted on the second diaphragm.

A valve body of the above-mentioned valve mechanism is connected to the first and second diaphragms so that a first force generated by the first differential pressure is exerted thereon in a valve opening direction and a second force generated by the second differential pressure is exerted thereon in a valve closing direction. Thus, the valve mechanism is maintained to be in a state where the first and second forces are balanced. As mentioned above, the first differential pressure corresponds to a specific volume of intake air and the second differential pressure corresponds to an amount of fuel which is delivered from the fuel chamber. Thus, the injection quantity control apparatus can adjust an amount of fuel delivered therefrom in accordance with a specific volume of intake air. The fuel which is delivered from the injection quantity control apparatus is supplied to injection nozzles, and the nozzles continuously inject fuel into the respective intake pipes.

Additionally, the second differential pressure changes in accordance with an opening of the mixture valve, as mentioned above. Thus, it is possible to adjust an injection quantity by manually operating a mixture lever so that an opening of the mixture valve is changed.

While the aircraft is in flight, it is necessary to adjust the injection quantity so that a lean air-fuel ratio is achieved in view of improving fuel economy. However, according to the above-mentioned conventional injection quantity control apparatus, the operator must manually operate the mixture lever while monitoring, for example, an exhaust gas temperature. Such an operation forces a burden on a pilot of the aircraft.

SUMMARY OF THE INVENTION

It is an object of the present invention to provide an injection quantity control apparatus for an internal combustion engine which can achieve a desired air-fuel ratio without a necessity of a manual operation by an operator.

The object of the present invention can be achieved by an injection quantity control apparatus provided to an internal combustion engine having an injection nozzle which continuously injects fuel, the apparatus comprising:

- a fuel quantity adjustment mechanism which has a static pressure chamber and a total pressure chamber to which a static pressure and a total pressure of an intake pipe of the engine are supplied, respectively, and adjusts an amount of fuel supplied to the injection nozzle in accordance with a dynamic pressure between a pressure of the static pressure chamber and a pressure of the total pressure chamber; and
- a dynamic pressure corrector which corrects the dynamic pressure so that an air-fuel ratio of the engine is controlled to be substantially a target value.

In this invention, a dynamic pressure between the static pressure and the total pressure of the intake pipe corresponds to a specific volume of intake air. Thus, an injection quantity can be controlled in accordance with the specific volume of intake air since the fuel quantity adjustment mechanism adjusts the amount of fuel supplied to the injection nozzle in accordance with the dynamic pressure between the pressure of the static pressure chamber and the pressure of the total pressure chamber. Thus, according to the invention, a target air-fuel ratio can be achieved without a necessity of a manual operation by an operator.

The injection quantity control apparatus may further comprise an air density compensator which corrects the dynamic pressure in accordance with a density of intake air of the internal combustion engine. In this case, a change in the injection quantity due to a change in the density of intake air can be compensated for.

The dynamic pressure corrector may comprise:

- a connecting passage which connects a static pressure supply passage for supplying the static pressure to the static pressure chamber and a total pressure supply passage for supplying the total pressure to the total pressure chamber;
- a control valve which is provided to the connecting passage;
- a first orifice which is provided to the total pressure supply passage or the static pressure supply passage at a position between the connecting passage and the intake pipe; and a valve controller which controls the control valve based on an intake manifold pressure and an engine speed of the engine.

In view of improving a fail-safe performance against a failure of the control valve, the dynamic pressure corrector may further comprise a second orifice provided to the connecting passage in series with the control valve.

In this invention, the dynamic pressure ΔP between the pressure of the static pressure chamber and the pressure of the total pressure chamber is equal to the dynamic pressure $\Delta P_0$ between the static pressure and the total pressure of the intake pipe multiplied by a sum of a flow resistance $D_2$ of the second orifice and a flow resistance $D_3$ of the control valve and divided by a sum of a flow resistance D1 of the first orifice and the flow resistances D2 and D3. That is, the dynamic pressure ΔP is expressed by the following equation:

$$\Delta P=\Delta P_0\cdot(D_2+D_3)/(D_1+D_2+D_3)$$

Thus, when an opening of the control valve changes, the dynamic pressure ΔP changes in accordance with a change in the flow resistance $D_3$ of the control valve. The valve controller controls the control valve based on the intake manifold pressure and the engine speed. Thus, the dynamic pressure corrector can corrects the dynamic pressure ΔP so that the air-fuel ratio is substantially equal to the target value.

The dynamic pressure ΔP becomes a minimum value $\Delta P_0\cdot D_2/(D_1+D_2)$ when the control valve is fully opened ($D_3$=0), and becomes a maximum value $\Delta P_0$ when the control valve is fully closed ($D_3$is infinity). Thus, if a failure of the control valve has occurred, the injection quantity can be prevented from being excessively small or large since the dynamic pressure ΔP is maintained between the above-mentioned minimum and maximum values.

Alternatively, the dynamic pressure corrector may comprise:

a connecting passage which connects a static pressure supply passage for supplying the static pressure to the static pressure chamber and a total pressure supply passage for supplying the total pressure to the total pressure chamber;

a first orifice which is provided to the connecting passage;

a control valve which is provided to the total pressure supply passage or the static pressure supply passage at a position between the connecting passage and the intake pipe; and a valve controller which controls the control valve based on an intake manifold pressure and an engine speed of the engine.

In view of improving a fail-safe performance against a failure of the control valve, the dynamic pressure corrector may further comprise a second orifice provided in parallel with the control valve.

In this invention, the dynamic pressure ΔP between the pressure of the static pressure chamber and the pressure of the total pressure chamber is equal to the dynamic pressure $\Delta P_0$ between the static pressure and the total pressure of the intake pipe multiplied by a flow resistance $D_4$ of the first orifice and divided by a sum of the flow resistance D4 and a parallel combined resistance $D_s$ of a flow resistance $D_5$ of the control valve and a flow resistance $D_6$ of the second orifice. That is, the dynamic pressure ΔP is expressed by the following equation.

$$\Delta P=\Delta P_0\cdot D_4/(D_4+_s)$$

Thus, when an opening of the control valve changes, the dynamic pressure ΔP changes in accordance with a change in the parallel combined resistance $D_s$. The valve controller controls the control valve based on the intake manifold pressure and the engine speed. Thus, the dynamic pressure corrector can correct the dynamic pressure ΔP so that the air-fuel ratio is substantially equal to the target value.

The dynamic pressure ΔP becomes a minimum value $\Delta P_0$ $D_4/(D_4+D_6)$ when the control valve is fully closed ($D_5$ is infinite), and becomes a maximum value $\Delta P_0$ when the control valve is fully opened ($D_5$=0). Thus, if a failure of the control valve has occurred, the injection quantity can be prevented from being excessively small or large since the dynamic pressure ΔP is maintained between the above-mentioned minimum and maximum values.

The dynamic pressure corrector may comprise:

a connecting passage which connects a static pressure supply passage for supplying the static pressure to the static pressure chamber and a total pressure supply passage for supplying the total pressure to the total pressure chamber;

an air density compensating valve which is provided to the connecting passage and changes an opening thereof in accordance with a density of intake air of the internal combustion engine;

an orifice which is provided to the total pressure supply passage or the static pressure supply passage at a position between the connecting passage and the intake pipe;

an opening changing part which changes an opening of the air density compensating valve independent of the density of intake air; and a valve controller which controls the air density control valve by means of the opening changing part so that an air-fuel ratio of the internal combustion engine is substantially equal to a target value.

In this invention, the dynamic pressure ΔP between a pressure of the static pressure chamber and a pressure of the total pressure chamber is equal to the dynamic pressure $\Delta P_0$ between the static pressure and the total pressure of the intake pipe multiplied by a flow resistance $D_7$ of the air density compensating valve and divided by a sum of the flow resistance D7 and a flow resistance $D_8$ of the orifice. That is, the dynamic pressure ΔP is expressed by the following equation.

$$\Delta P=\Delta P_0\cdot D_7/(D_7+D_8)$$

The air density control valve changes an opening thereof in accordance with a density of intake air. Thus, a change in the injection quantity, which is caused by a change in the density of intake air, can be compensated for by the dynamic pressure ΔP changing in accordance with the density of intake air. The valve controller controls an opening of the air density compensating valve by means of the opening changing part so that the target air-fuel ratio is substantially equal to a target value. Thus, the target air-fuel ratio can be achieved without a necessity of a manual operation by an operator.

The above-mentioned object can be also achieved by an injection quantity control apparatus provided to an internal combustion engine having an injection nozzle which continuously injects fuel, the apparatus comprising:

a fuel quantity adjustment mechanism which has a static pressure chamber to which a static pressure of an intake pipe of the engine is supplied, a total pressure chamber to which a total pressure of the intake pipe is supplied, and a valve mechanism which is actuated by a force in accordance with a dynamic pressure between a pressure of the static pressure chamber and a pressure of the total pressure chamber, the fuel quantity adjustment mechanism adjusting an amount of fuel supplied to the injection nozzle in accordance with an opening of the valve mechanism; and an actuating force corrector which corrects the force exerted on the valve mechanism so that an air-fuel ratio of the internal combustion engine is substantially equal to a target value.

In this invention, the valve mechanism is actuated by a force corresponding to the dynamic pressure between the static pressure and the total pressure of the intake pipe. Since the fuel quantity adjustment mechanism controls an amount of fuel supplied to the injection nozzle, the injection quantity can be controlled in accordance with the specific volume of intake air. The actuating force corrector corrects the force exerted on the valve mechanism so that the air-fuel ratio is substantially equal to a target value. Thus, the target air-fuel ratio can be achieved without a necessity of a manual operation by an operator.

The injection quantity control apparatus may comprise:

a start time fuel adjuster which adjusts an amount of fuel supplied to the injection nozzle in accordance with an engine temperature and an engine speed when the internal combustion engine is started.

When the engine is started, since the engine temperature is low and the specific volume of intake air is small, a proper injection quantity cannot be achieved by only adjusting the injection quantity in accordance with a volume of intake air. The start time fuel adjuster adjusts the injection quantity based on the engine temperature and the engine speed when the engine is started. Thus, according to the invention, a proper injection quantity can be achieved without a necessity of a manual operation by an operator when the engine is started.

The start time fuel adjuster may comprise:

a bypass passage which bypasses the fuel quantity adjustment mechanism;

a valve which is provided to the bypass passage; and a valve controller which controls an opening of the valve in accordance with the engine temperature and the engine speed.

In this invention, the start time fuel adjuster includes a bypass passage which bypasses the fuel quantity adjustment mechanism. Thus, the injection quantity corresponds to a sum of an amount of fuel supplied to the injection nozzle from the fuel quantity adjustment mechanism and an amount of fuel supplied to the injection nozzle via the bypass passage. An amount of the fuel supplied to the injection nozzle via the bypass passages changes in accordance with an opening of the valve provided to the bypass passage. Thus, the start time fuel adjuster can adjust the injection quantity in accordance with the engine temperature and the engine speed.

The start time fuel adjuster may comprise:

a bypass passage which bypasses the fuel quantity adjustment mechanism; and a pump controller which controls a discharge pressure of a fuel pump which supplies fuel to the fuel quantity adjustment mechanism in accordance with the engine temperature and the engine speed.

In this invention, the pump controller controls a discharge pressure of the fuel pump in accordance with the engine temperature and the engine speed. An amount of the fuel supplied to the injection nozzle via the bypass passages changes in accordance with the discharge pressure of the fuel pump. Thus, the start time fuel adjuster can adjust the injection quantity in accordance with the engine temperature and the engine speed.

The start time fuel adjuster may comprise:

a bypass passage which bypasses the fuel quantity adjustment mechanism;

first and second valves provided to the bypass passage in series with each other;

a valve controller which controls an opening of the first valve based on the engine temperature and the engine speed; and a timer which closes the second valve after a predetermined time has passed after the internal combustion engine is started.

In this invention, the start time fuel adjuster includes the valve controller which controls the opening of the first valve based on the engine temperature and the engine speed. An amount of fuel supplied to the injection nozzle via the bypass passage changes in accordance with the opening of the first valve. Thus, the start time fuel adjuster can adjust the injection quantity in accordance with the engine temperature and the engine speed. The second valve is closed after the predetermined time has passed after the engine is started. Thus, it is possible to prevent the injection quantity from being unduly increased after the engine is started if the first valve is fixed to be opened due to a failure thereof.

The injection quantity control apparatus may comprise:

an adjustment prohibiting part which prohibits the start time fuel adjuster from adjusting an amount of fuel delivered to the injection nozzle when the engine speed is greater than a predetermined value.

In this invention, when the engine speed is greater than the predetermined value, it can be judged that the engine has been started. In such a case, the adjustment prohibiting part prohibits the start time fuel adjuster from adjusting an amount of fuel delivered to the injection nozzle. Thus, it is possible to prevent the injection quantity from being unduly increased if a signal indicating a start operation of the engine is erroneously generated.

The injection quantity control apparatus including the valve mechanism which is actuated by a force exerted by the dynamic pressure between the static pressure chamber and the total pressure chamber may comprise:

a start time fuel adjuster which exerts a force on the valve mechanism in accordance with the engine temperature and the engine speed in at least one of a valve opening direction and a valve closing direction when the internal combustion engine is started.

In this invention, when the force exerted by the dynamic pressure and the force exerted by the start time fuel adjuster are balanced, fuel is delivered from the valve mechanism with a flow rate corresponding to a specific volume of intake air. The start time fuel adjuster exerts the force on the valve mechanism in accordance with the engine temperature and the engine speed in at least one of a valve opening direction and a valve closing direction When a force is exerted on the valve mechanism in the valve opening direction or the valve closing direction, a balance state of the forces is changed so that the amount of fuel delivered from the fuel quantity adjustment mechanism is changed in accordance with the force exerted by the start time fuel adjuster. Thus, the start time fuel adjuster can adjust the injection quantity in accordance with the engine temperature and the engine speed.

Other objects and further features of the present invention will be apparent from the following detailed description when read in conjunction with the accompanying drawings.

DESCRIPTION OF THE PREFERRED EMBODIMENTS

Figure 1:
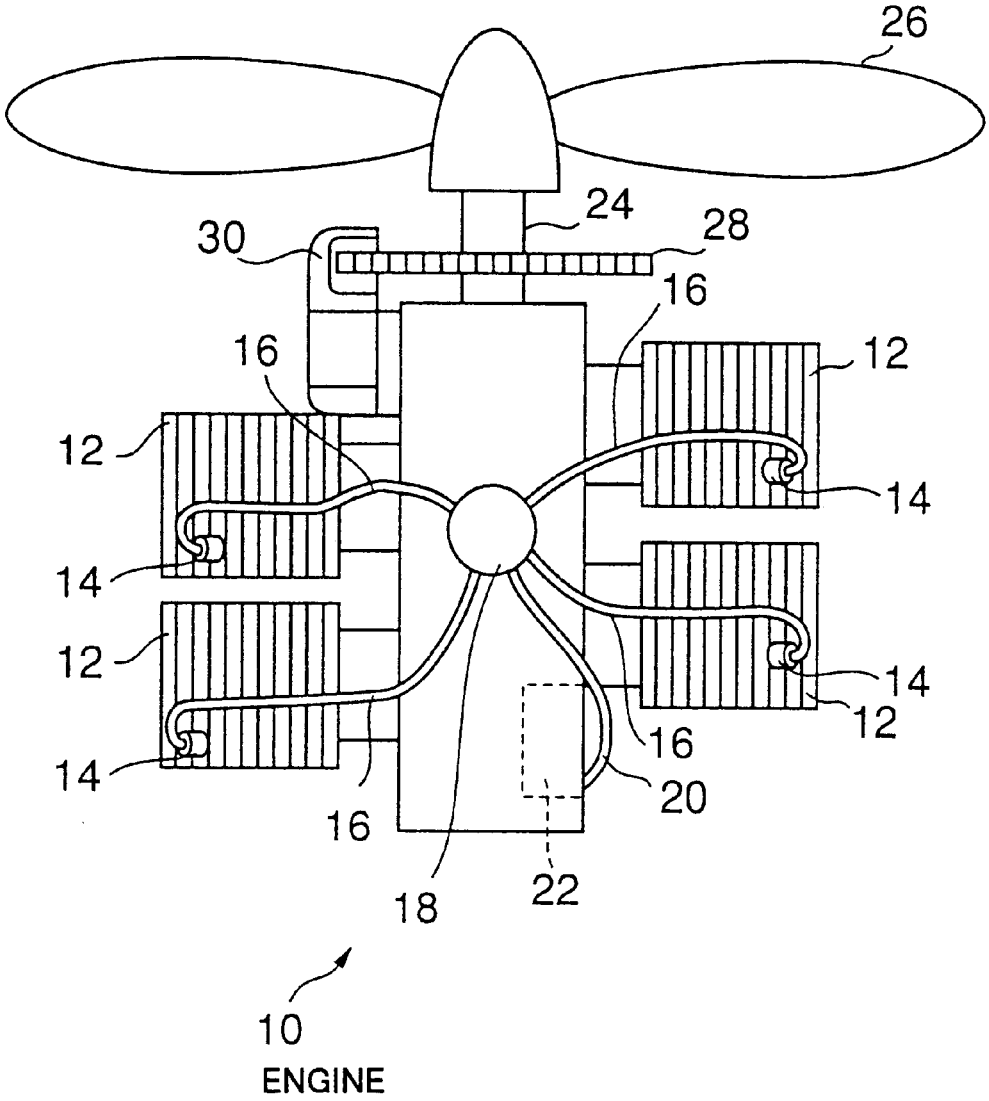
FIG. 1 is a diagram showing a plan view of an internal combustion engine to which an injection quantity control apparatus of a first embodiment of the present invention is applied.

FIG. 1 is a diagram showing a plan view of an internal combustion engine 10 (hereinafter simply referred to as an engine 10) to which an embodiment of an injection quantity control apparatus according to the present invention is applied. The engine 10 is adapted to be used for light aircraft.

As shown in FIG. 1, the engine 10 has four cylinders 12. An injection nozzle 14 is provided to each of the cylinders 12. Each injection nozzle 14 is connected to a flow divider 18 via a fuel pipe 16. The flow divider 18 is connected to a fuel quantity adjustment mechanism 22 via a fuel pipe 20. The flow divider 18 distributes fuel which is supplied from the fuel quantity adjustment mechanism 22 to each injection nozzle 14. The nozzles 14 continuously inject the fuel into the respective intake pipes.

A propeller 26 is fixed to an output shaft 24 of the engine 10. The engine 10 is cooled by the propeller 26 rotating when the engine 10 operates. A starter 30 is connected to the output shaft 24 via a ring gear 28. Cranking of the engine 10 is performed by means of the starter 30.

Figure 2:
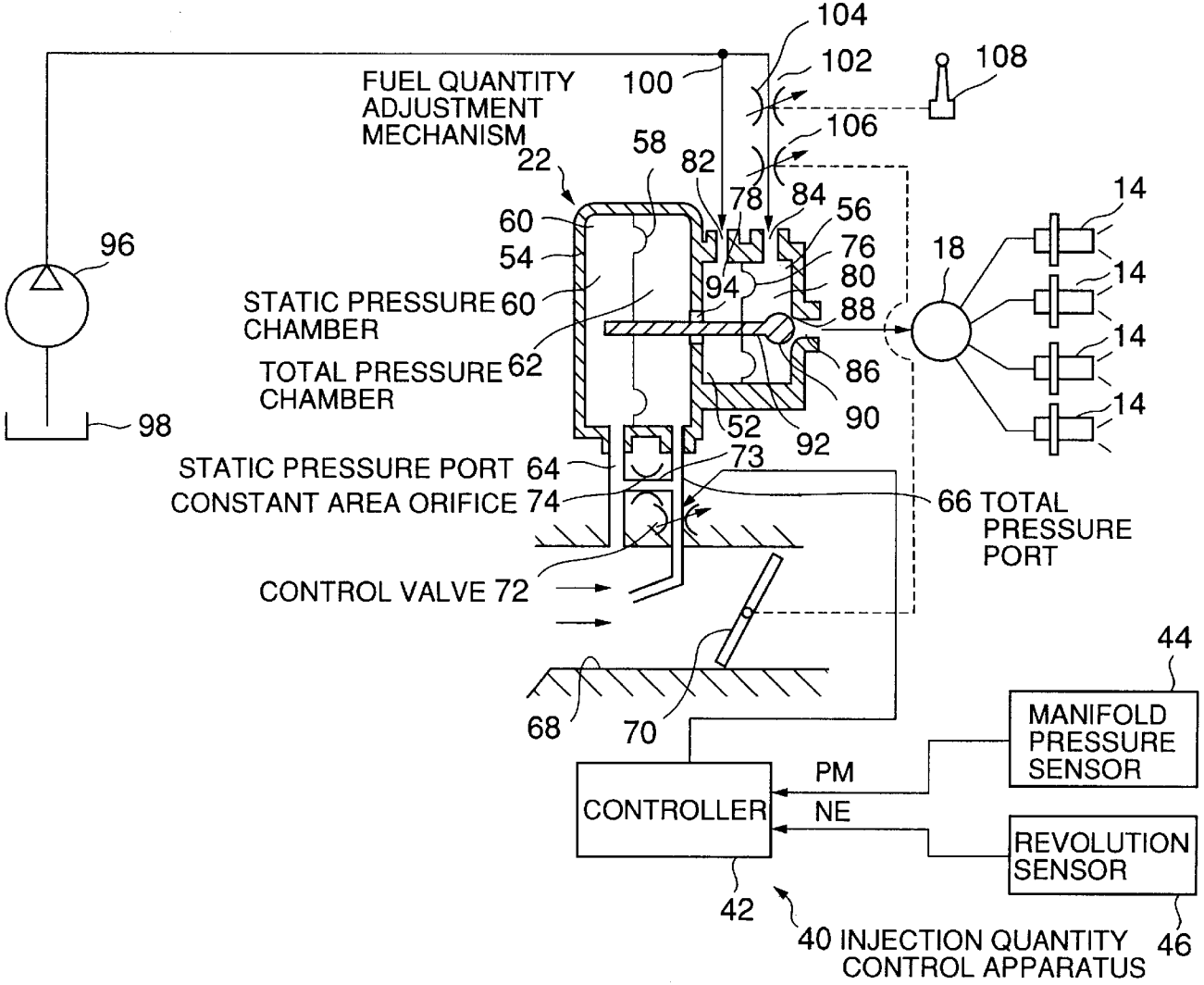
FIG. 2 is a diagram showing a structure of the injection quantity control apparatus of the first embodiment.

FIG. 2 is a diagram showing a system structure of an injection quantity control apparatus 40 of an embodiment of the present invention. The injection quantity control apparatus 40 is controlled by a controller 42. As shown in FIG. 2, a manifold pressure sensor 44 is connected to the controller 42. The manifold pressure sensor 44 outputs an electric signal in accordance with an intake manifold pressure PM. The controller 42 detects the intake manifold pressure PM based on the output signal of the manifold pressure sensor 44. Additionally, a revolution sensor 46 is connected to the controller 42. The revolution sensor 46 outputs a pulse signal each time the output shaft 24 of the engine 10 rotates a predetermined angle. The controller 42 detects an engine speed NE based on the output signal of the revolution sensor 46.

As shown in FIG. 2, the injection quantity control apparatus 40 includes the above-mentioned fuel quantity adjustment mechanism 22. The fuel quantity adjustment mechanism 22 has a housing 50. An internal space of the housing 50 is divided by a wall 52 into an air volume measurement chamber 54 on the left side in FIG. 2 and a fuel quantity adjustment chamber 56 on the right side in FIG. 2.

A first diaphragm 58 is provided inside the air volume measurement chamber 54. The first diaphragm 58 divides the air volume measurement chamber 54 into a static pressure chamber 60 on the left side in FIG. 2 and a total pressure chamber 62 on the right side in FIG. 2. A static pressure port 64 and a total pressure port 66 are connected to the static pressure chamber 60 and the total pressure chamber 62, respectively. The static pressure port 64 opens on an internal wall of an intake pipe 68 of the engine 10 at a position upstream of a throttle valve 70. On the other hand, the total pressure port 66 projects into the intake pipe 68 at a position upstream of the throttle valve 70 and opens out in an upstream direction. Thus, the static pressure port 64 is supplied with a static pressure $P_0$ of the intake pipe 68, and the total pressure port 66 is supplied with a total pressure $P_1$ of the intake pipe 68.

A control valve 72 is provided in the total pressure port 66. The control valve 72 is a linear control valve which linearly changes an opening thereof in accordance with a control signal supplied from the controller 42. The static pressure port 64 and a part of the total pressure port 66 between the control valve 72 and the total pressure chamber 62 are connected to each other by a connecting passage 73. A constant area orifice 74 is provided to the connecting passage 73.

According to the above-mentioned structure, a pressure $P_I$ in the static pressure chamber is maintained to be equal to the static pressure $P_0$. On the other hand, a pressure $P_{II}$ in the total pressure chamber 66 is regulated to be a pressure obtained, in part, by dividing a dynamic pressure between the static pressure $P_0$ and the total pressure $P_1$ by a flow resistance $R_1$ of the constant area orifice 74 and a flow resistance $R_2$ of the control valve 72. That is, the pressure $P_{II}$ in the total pressure chamber 66 is expressed by the following equation(1).

$$P_{II}=P_0+(P_1-P_0)\cdot R_1/(R_1+R_2) \quad (1)$$

When a flow speed of intake air into the intake pipe 68 is represented by v and a density of air is represented by ρ, the dynamic pressure $(P_1-P_0)$ between the total pressure $P_1$ and the static pressure $P_0$ is expressed by the following equation (2).

$$P_1-P_0=\rho\cdot v^2/2 \quad (2)$$

Thus, a dynamic pressure $\Delta P_1$ expressed by the following equation (3) is generated between the pressure $P_{II}$ of the total pressure chamber 66 and the pressure $P_I$ of the static pressure chamber 64.

$$\Delta P_1=P_{II}-P_I=\{R_1/(R_1+R_2)\}\cdot(P_1-P_0)=\{R_1/(R_1+R_2)\}\cdot\rho\cdot v^2/2 \quad (3)$$

A force $F_1$ which is proportional to the dynamic pressure $\Delta P_1$ ($F_1=C_1\cdot\Delta P_1$; $C_1$ is a proportionality constant) is exerted on the first diaphragm 58 in a direction toward the static pressure chamber 60.

A second diaphragm 76 is provided inside the fuel quantity adjustment chamber 56. The second diaphragm 76 divides the fuel quantity adjustment chamber 56 into a back pressure chamber 78 on the left side in FIG. 2 and a fuel chamber 80 on the right side in FIG. 2.

A back pressure port 82 and a fuel supply port 84 are provided to the back pressure chamber 78 and the fuel chamber 80, respectively. Additionally, a fuel delivery port 86 is provided to the fuel chamber 80. The fuel delivery port 86 is connected to the flow divider 18 via a pipe. A valve seat 88 is provided on an opening part of the fuel delivery port 86 to the fuel chamber 80.

A ball valve 90 is provided in the fuel chamber 80 so that the ball valve 90 faces the valve seat 88. The ball valve 90 is connected to a valve shaft 92. The valve shaft 92 extends through a through hole formed on the wall 52 being slidably guided by a guide member 94 provided in the through hole in a sealed manner, and is connected to the first diaphragm 58 and the second diaphragm 76. The ball 90 is biased by a spring (not shown) in a valve opening direction in which the ball valve 90 moves away from the valve seat 88. Thus, in a state where no force is exerted on the ball valve 90 from the first diaphragm 58 and the second diaphragm 76, a predetermined gap is formed between the ball valve 90 and the valve seat 88.

The injection quantity control apparatus 40 also includes a fuel pump 96. The fuel pump 96 pumps up fuel contained in a fuel tank 98 and discharges the fuel from a discharge port thereof. The discharge port of the fuel pump 96 is connected to the back pressure port 82 of the fuel quantity adjustment mechanism 22 via a fuel supply passage 100. Thus, the back pressure port 82 is directly supplied with a fuel pressure discharged by the fuel pump 96. Hereinafter, the fuel pressure supplied to the back pressure port 82 from the fuel pump 96 is referred to as a supplied fuel pressure $P_P$.

Additionally, the discharge port of the fuel pump 96 is connected to the fuel supply port 84 of the fuel quantity adjustment mechanism 22 via a fuel supply passage 102. A mixture valve 104 and a throttle-linked valve 106 are provided to the fuel supply passage 102 in series. Thus, the fuel supply port 84 is supplied with a fuel pressure discharged by the fuel pump 96 via the mixture valve 104 and the throttle-linked valve 106.

The mixture valve 104 is connected to a mixture lever 108. The mixture lever 108 is provided in a pilot seat of the aircraft on which the engine 10 is mounted. An opening of the mixture valve 104 is changed by the mixture lever 108 being operated by a pilot.

The throttle-linked valve 106 is connected to the throttle valve 70. When the throttle valve 70 is in a position near a fully-closed position, an opening of the throttle-linked valve 106 increases as an opening of the throttle valve 70 becomes smaller, and, when an opening of the throttle valve 70 is more than a predetermined value, the throttle-linked valve 106 is maintained in a substantially fully-opened position.

As mentioned above, a fuel pressure which is discharged by the fuel pump 96 is supplied to the fuel chamber 80 via the mixture valve 104 and the throttle-linked valve 106. Thus, when the ball valve 90 is released from the valve seat 88, fuel is delivered from the fuel delivery port 86 with a flow rate Q corresponding to a gap between the ball valve 90 and the valve seat 88. When fuel is delivered from the fuel delivery port 86 with the flow rate Q, a pressure drop R·Q (R is a sum of flow resistances of the mixture valve 104 and the throttle-linked valve 106) is generated across the mixture valve 104 and the throttle-linked valve 106. Thus, a pressure $P_B$ in the fuel chamber 80 is equal to $(P_P-R\cdot Q)$. On the other hand, a pressure $P_A$ in the back pressure chamber 78 is maintained to be the supplied fuel pressure $P_P$. Thus, a differential pressure $\Delta P_2$, which is expressed by the following equation (4), is generated between the fuel pressure $P_A$ of the back pressure chamber and the fuel pressure $P_B$ of the fuel chamber 80.

$$\Delta P_2=P_A-P_B=R\cdot Q \quad (4)$$

Thus, a force $F_2$ which is proportional to the differential pressure $\Delta P_2$ ($F_2=C_2\cdot R\cdot Q$; $C_2$ is a proportionality constant) is exerted on the second diaphragm 76 in a direction toward the fuel chamber 80. The force $F_2$ is transmitted to the ball valve 90 as a force in a valve closing direction in which the ball valve 90 moves toward the valve seat 88.

As mentioned above, the force $F_1$ ($=C_1\cdot\Delta P_1$) in the valve opening direction and the force $F_2$ ($=C_2\cdot R\cdot Q$) in the valve closing direction are exerted on the ball valve 90. Thus, the following equation (5) is derived from a force balance $F_1=F_2$.

$$C_1\cdot\Delta P_1=C_2\cdot R\cdot Q \quad (5)$$

From the equation (5), the following equation (6) is derived.

$$Q=(C_1/C_2)\cdot\Delta P_1/R \quad (6)$$

This equation (6) shows that fuel is supplied to the flow divider 18 with a flow rate Q in accordance with the dynamic pressure $\Delta P_1$ between the pressure $P_I$ of the static pressure chamber 60 and the pressure $P_{II}$ of the total pressure chamber 62.

A state which is equivalent to a state where neither the control valve 72 nor the constant area orifice 74 is provided, that is, where only an original structure of the fuel adjustment mechanism 22 is used, can be achieved by setting the flow resistance $R_1$ of the constant area orifice 74 to be infinity and the flow resistance $R_2$ of the control valve 72 to be zero. In such a state, the dynamic pressure $\Delta P_1$ shown by the equation (3) is expressed by the following equation (7).

$$\Delta P_1 = P_1 - P_0 = \rho \cdot v^2/2 \quad (7)$$

Thus, the fuel quantity adjustment mechanism 22 can deliver fuel with a flow rate Q which is proportional to $\rho \cdot v^2/2$ irrespective of a value of the supplied fuel pressure $P_P$. Additionally, the flow resistance R in the above-mentioned equation (6) becomes larger as an opening of the mixture valve 104 decreases. Thus, the pilot can manually adjust an amount of fuel delivered from the fuel quantity adjustment mechanism 22 by operating the mixture lever 108 so that an opening of the mixture valve 104 is changed. As mentioned above, the flow divider 18 distributes fuel delivered from the fuel quantity adjustment mechanism 22 to each of the injection nozzles 14. Thus, according to the fuel quantity adjustment mechanism 22, it is possible to manually adjust an injection quantity by operating the mixture lever 108 while controlling the injection quantity in accordance with $\rho \cdot v$, that is, in accordance with a specific volume of intake air.

In an idling state where the throttle valve 70 is maintained in a position near a fully closed position, since a specific volume of intake air is small, a dynamic pressure $\Delta P_1$ which is sufficient to deform the first diaphragm 108 is not generated between the total pressure $P_1$ and the static pressure $P_0$. However, in a state where neither the force $F_1$ nor $F_2$ is exerted on the ball valve 90, a gap is generated between the ball valve 90 and the valve seat 88 due to a biasing force in the valve opening direction, as mentioned above. Thus, the fuel quantity adjustment mechanism 22 can deliver fuel from the fuel delivery port 86 in the idling state. Additionally, an opening of the throttle-linked valve 106 increases as an opening of the throttle valve 70 becomes smaller when the throttle valve 70 is in a position near a fully closed position, as mentioned above. When an opening of the throttle-linked valve 106 increases, the flow rate Q becomes larger since the flow resistance R decreases. Thus, the fuel quantity adjustment mechanism 22 can deliver fuel with a flow rate Q which corresponds to an opening of the throttle valve 70.

When the aircraft on which the engine 10 is mounted is in flight, it is required to adjust the injection quantity so that a stoichiometric or lean air-fuel ratio is achieved. An exhaust gas temperature of the engine 10 becomes maximum when a stoichiometric air-fuel ratio is achieved. Additionally, the injection quantity can be adjusted by manually operating the mixture lever 108, as mentioned above. Thus, according to the fuel quantity adjustment mechanism 22, the pilot can achieve a desired air-fuel ratio by manually operating the mixture lever 108 while monitoring the exhaust gas temperature of the engine 10. However, such a manual operation for adjusting the injection quantity forces a burden on the pilot.

According to the injection quantity control apparatus 40 of the present embodiment, since the control valve 72 and the constant area orifice 74 are provided, the dynamic pressure $\Delta P_1$ is expressed by the equation (3) and the flow rate Q of fuel delivered from the fuel quantity adjustment mechanism 22 is expressed by the equation (6). In the equation (3), the flow resistance $R_2$ of the control valve 72 changes between "0" (when the control valve 72 is fully opened) and "infinity" (when the control valve 72 is fully closed) in accordance with an opening of the control valve 72. Thus, according to the equations (2), (3), and (6), the flow rate Q changes between "0" (when the control valve 72 is fully closed) and "$(1/R)\cdot(C_1/C_2)\cdot\rho\cdot v^2/2$" (when the control valve 72 is fully opened). In this way, it is possible to reduce the injection quantity in accordance with a decrease in the dynamic pressure $\Delta P_1$ by decreasing an opening of the control valve 72, that is, by increasing the flow resistance $R_2$.

As mentioned above, the injection quantity can be adjusted to decrease based on an opening of the control valve 72. Thus, the injection quantity control apparatus 40 of the present embodiment automatically adjusts the injection quantity so that a target air-fuel ratio is achieved by controlling an opening of the control valve 72 in accordance with a control signal supplied from the controller 42 to the control valve 72 while the engine 10 is operating.

Figure 3:
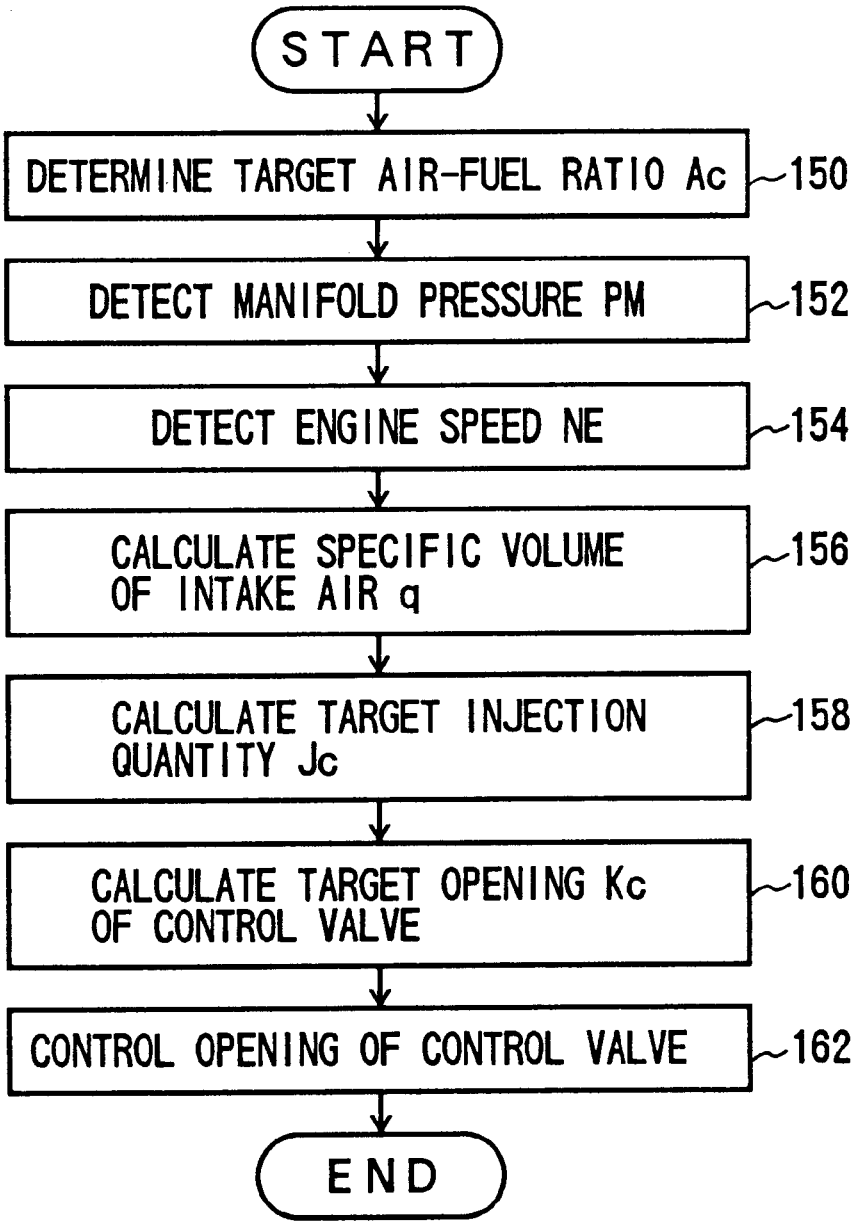
FIG. 3 is a flowchart performed by a controller so as to control an injection quantity in the first embodiment.

FIG. 3 shows a flowchart of a control routine performed by the controller 42 so as to adjust the injection quantity in the above-mentioned manner. The routine shown in FIG. 3 is repeatedly started every time when one process cycle thereof is finished while the engine 10 is operating. When the routine is started, the process of step 150 is performed first.

In step 150, a target air-fuel ratio $A_c$ is determined.

The target air-fuel ratio $A_c$ may be a predetermined value near a stoichiometric air-fuel ratio, or may be set by the pilot through an operating panel of the aircraft.

In step 152, the intake manifold pressure PM is detected based on the output signal of the manifold pressure sensor 44.

In step 154, the engine speed NE is detected based on the output signal of the revolution sensor 46.

In step 156, a specific volume of intake air q is calculated based on the intake manifold pressure PM and the engine speed NE. The specific volume of intake air q changes proportionally to each of the intake manifold pressure PM and the engine speed NE. A representation of the specific volume of intake air q in relation to the intake manifold pressure PM and the engine speed NE is stored in the controller 42 as a map or an experimental equation. The controller 42 calculates the specific volume of intake air q by referring to the map or the experimental equation in step 156.

In step 158, a target injection quantity $J_c$ is calculated based on the specific volume of intake air q and the target air-fuel ratio $A_c$.

In step 160, a target opening $K_c$ of the control valve 72 for achieving the target injection quantity $J_c$ is calculated.

In step 162, a control signal is supplied to the control valve 72 so that an opening of the control valve 72 is controlled to be the target opening $K_c$. When the process of step 162 is finished, the present routine is ended.

According to the control routine shown in FIG. 3, the injection quantity is automatically adjusted so that the target air-fuel ratio is achieved. Thus, according to the injection quantity control apparatus 40 of the present embodiment, since the pilot need not manually operate the mixture lever 108 to adjust the injection quantity while the aircraft is in flight, a burden on the pilot can be reduced.

In the above-mentioned embodiment, the control valve 72 is provided to the total pressure port 66 and the constant area orifice 74 is provided to the connecting passage 73. However, the positions of the control valve 72 and the constant area orifice 74 may be exchanged. In this case, the dynamic pressure $\Delta P_1$ is expressed by the following equation (8) which is obtained by exchanging $R_1$ and $R_2$ in the equation (3).

$$\Delta P_1=\{R_2/(R_1+R_2)\}\cdot(P_1-P_2) \quad (8)$$

That is, in a structure where the control valve 72 is provided to the connecting passage 73 and the constant area orifice 74 is provided to the total pressure port 66, the injection quantity can be reduced by increasing an opening of the control valve 72 (by decreasing the flow resistance $R_2$) so that the dynamic pressure $\Delta P_1$ is decreased.

Additionally, in the above-mentioned embodiment, a linear control valve is used as the control valve 72. However, it is possible to use an ON/OFF valve as the control valve 72. In this case, the injection quantity is switched between two levels by turning on and off the ON/OFF valve so that the target air-fuel ratio $A_c$ is achieved.

Further, although the control valve 72 is provided to the total pressure port 66 in the above-mentioned embodiment, the control valve 72 may be provided to the static port 64 at a position between the connecting passage 72 and the intake pipe 68. In this case, the dynamic pressure $\Delta P_1$ is expressed by the above-mentioned equation (3) with the pressure $P_I$ of the static pressure chamber 60 changing in accordance with an opening of the control valve 72.

Figure 4:
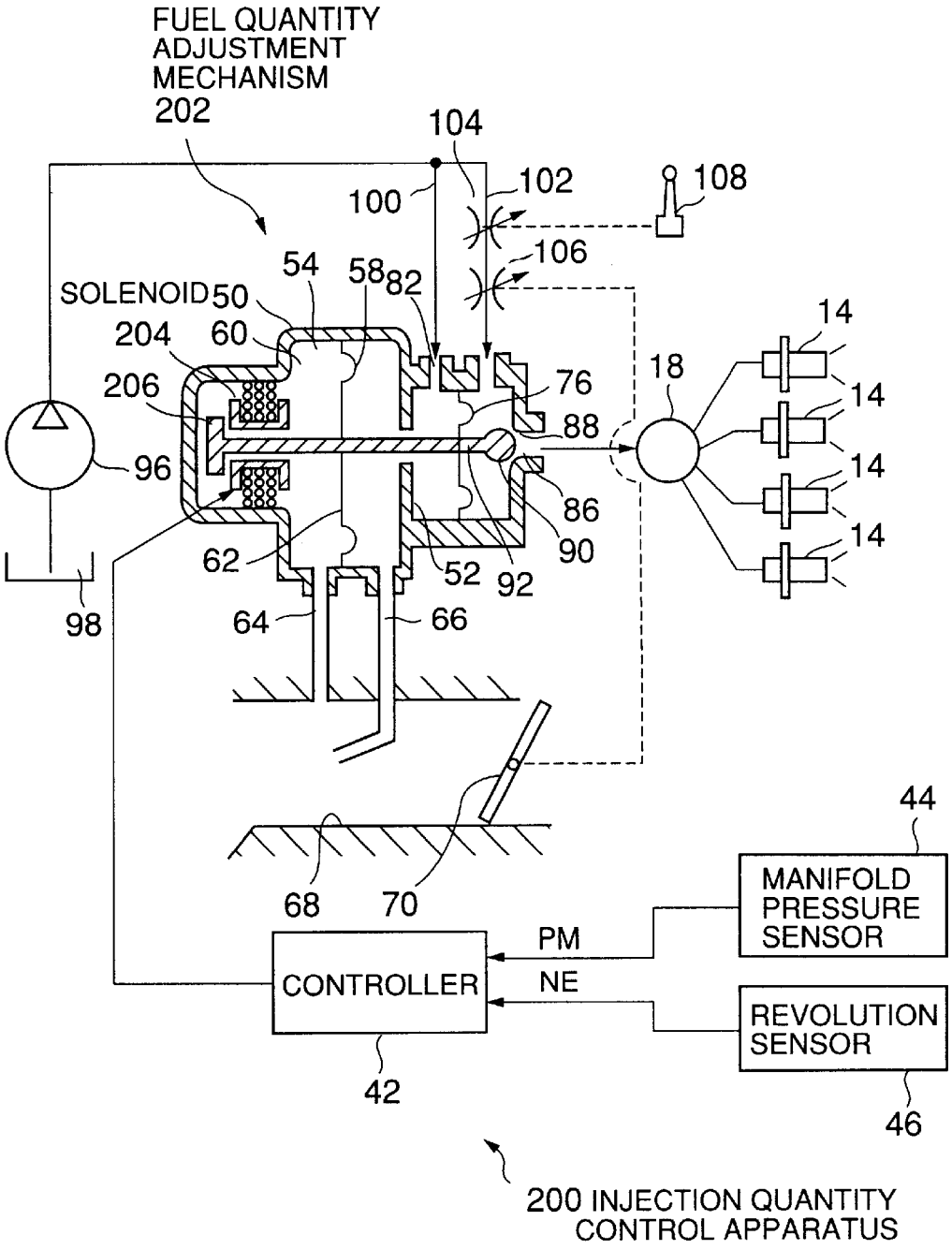
FIG. 4 is a diagram showing a structure of an injection quantity control apparatus of a second embodiment of the present invention.

Next, a description will be given of a second embodiment of the present invention. FIG. 4 is a diagram showing a structure of an injection quantity control apparatus 200 of the present embodiment. The injection quantity control apparatus 200 is achieved by replacing the fuel quantity adjustment mechanism 22 with a fuel quantity adjustment mechanism 202 and omitting the control valve 72, the connecting passage 73 and the constant area orifice 74 in the injection quantity control apparatus 40 of the first embodiment. In FIG. 4, parts that are the same as the parts shown in FIG. 2 are given the same reference numerals, and descriptions thereof will be omitted.

As shown in FIG. 4, the fuel quantity adjustment mechanism 202 includes a solenoid 204. The solenoid 204 is disposed to the left in FIG. 4 of the air volume measurement chamber 54 so that the valve shaft 92 extends through a center part of the solenoid 204. An armature 206 is connected to a left end of the valve shaft 92. The armature 206 is a disk-like member which is formed from a magnetic material. The armature 206 faces a left end face of the solenoid 204 in FIG. 4 with a predetermined clearance being therebetween. The solenoid 204 is electrically connected to the controller 42. The controller supplies an exciting current to the solenoid 204.

According to the above-mentioned structure, when an exciting current is supplied to the solenoid 204, a magnetic attracting force is exerted between the armature 206 and the solenoid 204 in accordance with an amplitude of the exciting current. This magnetic attracting force is transmitted to the ball valve 90 as a force Fm in the valve closing direction.

In the fuel quantity adjustment mechanism 202 of the present embodiment, the static pressure $P_0$ is directly supplied to the static pressure chamber 60 and the total pressure $P_1$ is directly supplied to the total pressure chamber 62. Thus, the dynamic pressure $\Delta P_1$ between the pressure $P_{II}$ of the static chamber 60 and the pressure $P_{II}$ of the total pressure chamber 62 is expressed by the following equation (9).

$$\Delta P_1=P_1-P_2=\rho\cdot v^2/2 \quad (9)$$

As mentioned in the first embodiment, the force $F_1$ ($=C_1\cdot\Delta P_1$) in the valve opening direction and the force $F_2$ ($=C_2\cdot R\cdot Q$) in the valve closing direction are exerted on the ball valve 90 by the first diaphragm 58 and the second diaphragm 76, respectively. Thus, the following equation (10) can be obtained from a balance of the forces $F_1$, $F_2$ and Fm.

$$C_1\rho\cdot v^2/2=C_2\cdot R\cdot Q+F_m \quad (10)$$

The following equation (11) can be derived from the equation (10).

$$Q=(1/R)\cdot(C_1/C_2)\cdot\rho\cdot v^2/2-F_m/(C_2\cdot R) \quad (11)$$

According to the equation (11), the flow rate Q of fuel which is delivered from the fuel quantity adjustment mechanism 202 decreases as the force Fm becomes larger. In other words, the injection quantity can be reduced in accordance with the exciting current supplied to the solenoid 204. Thus, the injection quantity control apparatus 200 of the present embodiment controls the injection quantity by changing the exciting current supplied to the solenoid 204 from the controller 42.

Figure 5:
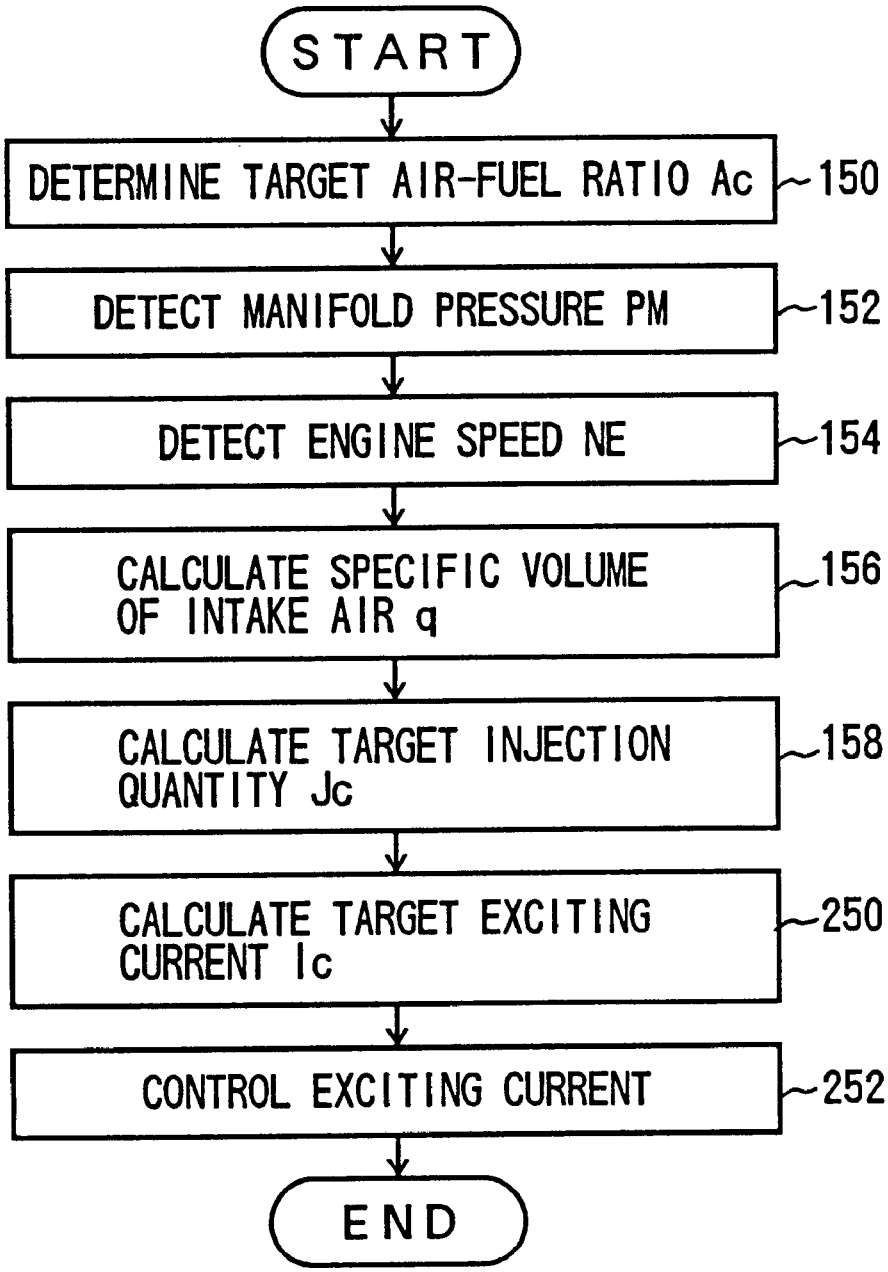
FIG. 5 is a flowchart performed by a controller so as to control an injection quantity in the second embodiment.

FIG. 5 shows a flowchart of a control routine performed by the controller 42 so as to control the injection quantity in the injection quantity control apparatus 200 of the present embodiment. The routine shown in FIG. 5 is repeatedly started every time when one process cycle thereof is finished. In FIG. 5, steps in which the same processes are performed as those of steps shown in FIG. 3 are given the same numerals, and descriptions thereof will be omitted.

In the routine shown in FIG. 5, after the target injection quantity $J_c$ is calculated in step 158, a target exciting current $I_c$ is calculated in step 250. The target exciting current $I_c$ is an exciting current which is to be supplied to the solenoid 204 in order to achieve the target injection quantity. In the subsequent step 252, the exciting current supplied to the solenoid 204 is controlled to be the target exciting current $I_c$, and then the present routine is ended.

According to the control routine shown in FIG. 5, the injection quantity can be controlled so that the target air-fuel ratio $A_c$ is achieved. Thus, according to the injection quantity control apparatus 200 of the present embodiment, since the pilot need not operate the mixture lever 108 to adjust the injection quantity while the aircraft is in flight, a burden forced on the pilot can be reduced.

Next, a description will be given of a third embodiment of the present invention.

Figure 6:
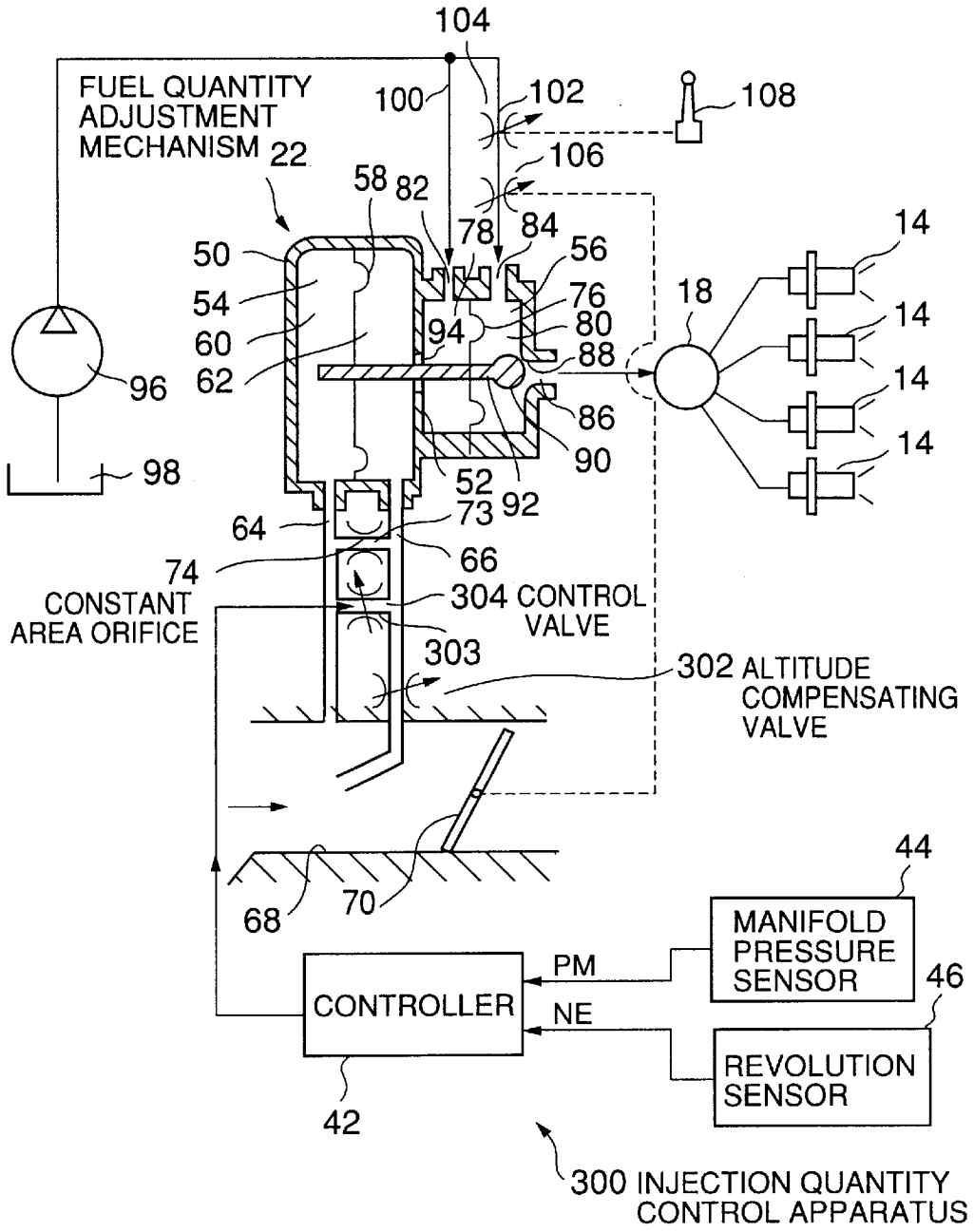
FIG. 6 is a diagram showing a structure of an injection quantity control apparatus of a third embodiment of the present invention.

FIG. 6 is a diagram showing a structure of an injection quantity control apparatus 300 of the present embodiment. The injection quantity control apparatus 300 is achieved by replacing the control valve 72 with an altitude compensating valve 302, providing a connecting passage 303 in parallel with the connecting passage 73, and providing a control valve 304 to the connecting passage 303 in the injection quantity control apparatus 40 of the first embodiment. In FIG. 6, parts that are the same as the parts shown in FIG. 2 are given the same reference numerals, and descriptions thereof will be omitted.

The altitude-compensating valve 302 linearly changes an opening thereof in accordance with a decrease in a density of intake air. As will be mentioned below, the altitude compensating valve 302 has a function of adjusting the injection quantity in accordance with a change in the density of intake air due to a change in an altitude of the aircraft. On the other hand, the control valve 304 is a linear solenoid valve which linearly changes an opening thereof in accordance with a control signal supplied from the controller 42.

As mentioned above, the injection quantity control apparatus 300 of the present embodiment has a structure in which the altitude compensating valve 302 is provided instead of the control valve 72 and the control valve 304 is provided in parallel with the constant area orifice 74 in the injection quantity control apparatus 40 of the first embodiment. Thus, when a flow resistance of the altitude compensating valve 302 is represented by $R_3$ and a flow resistance of the control valve 302 is represented by $R_4$, the dynamic pressure $\Delta P_1$ between the pressure $P_I$ of the static pressure chamber 60 and the pressure $P_{II}$ of the total pressure chamber 62 can be expressed by the following equation (12) which is obtained by replacing the flow resistance $R_1$ with a parallel combined resistance $R_s$ of the flow resistance $R_1$ and the flow resistance $R_4$ ($R_1=R_1 \cdot R_4/(R_s+R_4)$) in the above-mentioned equation (3).

$$\Delta P_1=(P_1-P_0)\cdot R_s/(R_s+R_3) \tag{12}$$

A density of intake air decreases as an altitude of the aircraft becomes higher. The fuel quantity adjustment mechanism 22 has a characteristic that the injection quantity increases relative to the specific volume of intake air as the density of intake air decreases if the altitude-compensating valve 302 is not provided. As mentioned above, the altitude compensating valve 302 decreases an opening thereof in accordance with a decrease in the density of intake air. When an opening of the altitude compensating valve 302 decreases, the flow rate Q expressed by the equation (6) decreases in accordance with a decrease in the dynamic pressure $\Delta P_1$ expressed by the equation (12) due to an increase in the flow resistance $R_3$ of the altitude compensating valve 302. Thus, according to the altitude compensating valve 302, it is possible to prevent the injection quantity from being excessive due to a decrease in the density of intake air when the altitude becomes high.

As seen from the equation (12), the dynamic pressure $\Delta P_1$ is decreased from a dynamic pressure ($P_1-P_0$) between the static pressure $P_0$ and the total pressure $P_1$ by being divided by the flow resistance $R_3$ of the altitude compensating valve 302 and the combined flow resistance Rs of the constant area orifice 74 and the control valve 304. The flow rate Q is reduced in accordance with such a decrease in the dynamic pressure $\Delta P_1$. The combined flow resistance Rs decreases as the flow resistance $R_4$ of the control valve 304 becomes smaller (that is, as an opening of the control valve 304 becomes larger). Additionally, as the combined flow resistance Rs becomes smaller, the flow rate Q decreases since the dynamic pressure $\Delta P_1$ decreases as seen from the equation (12). Accordingly, the flow rate Q can be reduced by increasing an opening of the control valve 304. Thus, the injection quantity control apparatus 300 of the present embodiment controls the injection quantity in accordance with a control signal supplied to the control valve 304 from the controller 42.

In the present embodiment, the controller 42 performs the above-mentioned routine shown in FIG. 3 while calculating a target opening of the control valve 304 to achieve the target injection quantity $J_c$ in step 158 and controlling an opening of the control valve 304 to be the target opening in step 160. Therefore, the injection quantity can be automatically adjusted so that the target air-fuel ratio $A_c$ is achieved. Thus, according to the present embodiment, since the pilot need not manually operate the mixture lever 108 to adjust the injection quantity while the aircraft is in flight, a burden forced on the pilot can be reduced.

In the above-mentioned third embodiment, a change in the injection quantity due to a change in a density of intake air is compensated for by the altitude-compensating valve 302. However, if such a compensation need not be performed, an orifice having a predetermined flow resistance may be provided instead of the altitude compensating valve 302.

Additionally, although the altitude compensating valve 302 is provided to the total pressure port 66 in the above-mentioned third embodiment, the altitude compensating valve 302 may be provided to a part of the static pressure port 64 between the intake pipe 68 and the connecting passage 303. In this case, the dynamic pressure $\Delta P_1$ is expressed by the equation (12) as in the case of the third embodiment, with the pressure $P_I$ of the static pressure chamber 60 changing in accordance with an opening of the altitude compensating valve 302.

Next, a description will be given of a fourth embodiment of the present invention.

Figure 7:
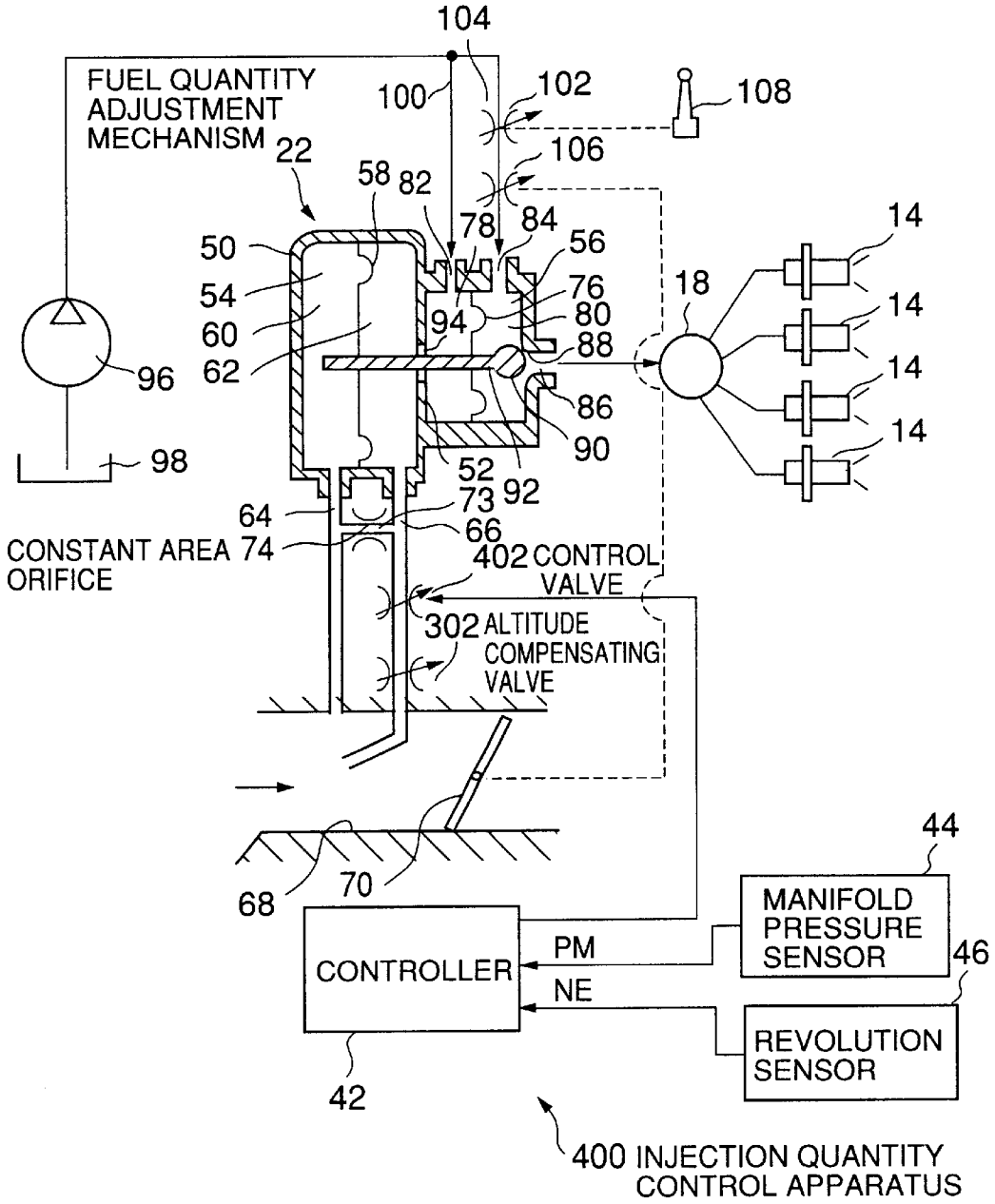
FIG. 7 is a diagram showing a structure of an injection quantity control apparatus of a fourth embodiment of the present invention.

FIG. 7 is a diagram showing a structure of an injection quantity control apparatus 400 of the present embodiment. The injection quantity control apparatus 400 of the present embodiment can be achieved by omitting the connecting passage 303 and the control valve 304 and providing a control valve 402 to the total pressure port 66 in series with the altitude compensating valve 302 in the injection quantity control apparatus 300 of the third embodiment. The control valve 402 is a linear solenoid valve which linearly changes an opening thereof in accordance with a control signal supplied from the controller 42. In FIG. 7, parts that are the same as the parts shown in FIG. 6 are given the same reference numerals, and descriptions thereof will be omitted.

The injection quantity control apparatus 400 has a structure in which the control valve 402 and the altitude compensating valve 302 are provided in series instead of the control valve 72 in the injection quantity control apparatus 40 of the first embodiment. Thus, if a flow resistance of the control valve 402 is represented by $R_5$, the dynamic pressure $\Delta P_1$ between the pressure $P_I$ of the static pressure chamber 60 and the pressure $P_{II}$ of the total pressure chamber 62 is expressed by the following equation (13) which is obtained by replacing the flow resistance $R_2$with a series combined resistance of the flow resistances $R_3$ and $R_5$ ($=R_3+R_5$) in the equation (3).

$$\Delta P_1=\{R_1/(R_1+R_3+R_5)\}\cdot(P_1-P_0) \tag{13}$$

Thus, in the present embodiment, the dynamic pressure $\Delta P_1$ decreases as an opening of the control valve 402 decreases (that is, as the flow resistance $R_5$ increases), and the flow rate Q decreases in accordance with the decrease in the dynamic pressure $\Delta P_1$.

In the present embodiment, the controller 42 performs the above-mentioned routine shown in FIG. 3 while calculating a target opening of the control valve 402 in step 158 and controlling an opening of the control valve 402 to be the target opening. Thus, the injection quantity can be controlled so that the target air-fuel ratio $A_c$ is achieved.

In the above-mentioned third and fourth embodiments, linear control valves are used as the control valves 302, 402. However, it is also possible to use ON/OFF valves as the control valves 302, 402. In this case, injection quantity is switched between two levels by turning on and off the ON/OFF valves so that the target air-fuel ratio $A_c$ is achieved.

Additionally, in the above-mentioned fourth embodiment, the control valve 402 and the altitude-compensating valve 302 are provided to the total pressure port 66. However, at least one of the control valve 402 and the altitude compensating valve 302 may be provided to a part of the static pressure port 64 between the intake pipe 68 and the connecting passage 73. In this case, the dynamic pressure $\Delta P_1$ is expressed by the equation (13) as in the case of the fourth embodiment, with the pressure $P_I$ of the static pressure chamber changing in accordance with an opening of the control valve 402 or the altitude compensating valve 302.

Next, a description will be given of a fifth embodiment of the present invention.

Figure 8:
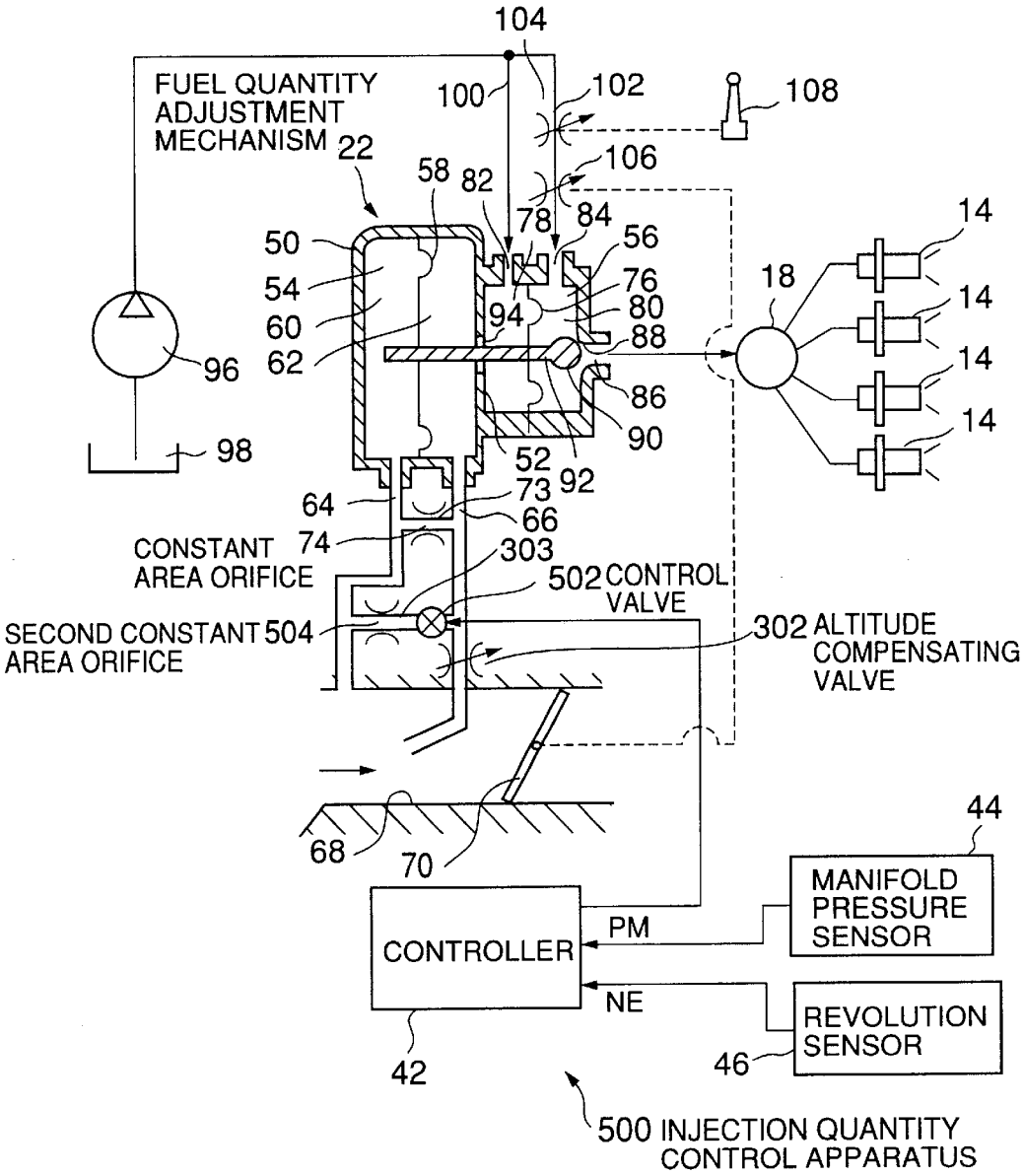
FIG. 8 is a diagram showing a structure of an injection quantity control apparatus of a fifth embodiment of the present invention.

FIG. 8 is a diagram showing a structure of an injection quantity control apparatus 500 of the present embodiment. The injection quantity control apparatus 500 is achieved by providing a control valve 502 and a second constant area orifice 504 in series instead of the control valve 304 in the injection quantity control apparatus 300 of the above-mentioned third embodiment. The control valve 502 is an ON/OFF solenoid valve which is opened (or closed) in a regular state and closed (or opened) when an ON signal is supplied from the controller 42. In FIG. 8, parts that are the same as the parts shown in FIG. 6 are given the same reference numerals, and descriptions thereof will be omitted.

As mentioned above, the injection quantity control apparatus 500 of the present embodiment has a structure in which the control valve 502 and the second constant area orifice 504 are provided in series instead of the control valve 304 in the injection quantity control apparatus 300 of the above-mentioned third embodiment. Thus, when a combined flow resistance of the constant area orifice 74, the second constant area orifice 504 and the control valve 502 is represented by Rs, the dynamic pressure $\Delta P_1$ between the pressure $P_I$ of the static pressure chamber 60 and the pressure $P_{II}$ of the total pressure chamber 62 is expressed by the above-mentioned equation (12). In the present embodiment, when a flow resistance of the second constant area orifice 504 is represented by $R_6$, the combined flow resistance $R_s$ in a state where the control valve 502 is opened is expressed by the following equation.

$$R_s=R_1\cdot R_6/(R_1+R_6) \text{ (hereinafter represented by } R_0)$$

Additionally, the combined flow resistance in a state where the control valve 502 is closed is expressed by the following equation.

$$R_s=R_1(>R_0)$$

Thus, the dynamic pressure $\Delta P_1$ in a state where the control valve 502 is opened is expressed by:

$$\Delta P_1=\Delta P_{1,1}=(P_1-P_0)\cdot R_0/(R_0+R_3),$$

and the dynamic pressure $\Delta P_1$ in a state where the control valve 502 is closed is expressed by:

$$\Delta P_1=\Delta P_{1,2}=(P_1-P_0)\cdot R_1/(R_1+R_3).$$

Accordingly, the flow rate Q in a state where the control valve 502 is opened is expressed by:

$$Q=Q_1=[R_0/\{R\cdot(R_0+R_3)\}]\cdot(C_1/C_2)\cdot\rho\cdot v^2/2,$$

and the flow rate Q in a state where the control valve 502 is closed is expressed by:

$$Q=Q_2=[R_1/\{R\cdot(R_1+R_3)\}]\cdot(C_1/C_2)\cdot\rho\cdot v^2/2.$$

Thus, in the present embodiment, the flow rate Q can be switched between $Q_1$ and $Q_2$ in accordance with an opening/closing state of the control valve 502.

The controller 42 opens the control 502 to achieve the flow rate $Q_1$ when it is determined that a desired lean air-fuel ratio can be achieved with the flow rate $Q_1$ based on a specific volume of intake air calculated from the intake manifold pressure PM and the engine speed NE. Thus, according to the present embodiment, the pilot can achieve the lean air-fuel ratio without operating the mixture lever 108.

As mentioned above, in the present embodiment, since the control valve 502 and the second constant area orifice 504 are provided in series, the dynamic pressure $\Delta P_1$ is generated in accordance with the flow resistance $R_6$ of the second constant area orifice 504 when the control valve 502 is opened. Thus, if the control valve 502 is fixed to be opened due to a failure, the flow rate Q can be maintained equal to or greater than $Q_1$. Additionally, if the control valve 502 is fixed to be closed to a failure, the flow rate Q can be maintained equal to or smaller than $Q_2$. As mentioned above, the flow rate $Q_1$ is set to be a value with which the lean air-fuel ratio can be achieved. Additionally, the flow rate $Q_2$ is a flow rate determined by an original property of the fuel quantity adjustment mechanism 22. Therefore, according to the injection quantity control apparatus 500 of the present embodiment, it is possible to prevent an air-fuel ratio from being excessively rich or lean since the flow rate Q is maintained between $Q_1$ and $Q_2$ when the control valve 502 is fixed to be closed or opened due to a failure. Thus, the injection quantity control apparatus 500 has a high fail-safe performance against a failure of the control valve 502.

In the above-mentioned fifth embodiment, the injection quantity is switched between two levels by the control valve 502 constituted as an ON/OFF solenoid valve. However, it is also possible to use a linear solenoid valve as the control valve 502 so that the flow rate Q can be linearly changed between $Q_1$ and $Q_2$. In this case, the injection quantity is continuously controlled based on the intake manifold pressure PM and the engine speed NE as in the case of the above-mentioned first to fourth embodiments.

Additionally, although the altitude compensating valve 302 is provided to the total pressure port 66 in the fifth embodiment, the altitude compensating valve 302 may be provided to a part of the static pressure port 64 between the intake pipe 68 and the connecting passage 303. In this case, the dynamic pressure $\Delta P_1$ is expressed by the above-mentioned equation (12) with the pressure $P_I$ of the static pressure chamber 60 changing in accordance with an opening of the control valve 502 or the altitude compensating valve 302.

Next, a description will be given of a sixth embodiment of the present invention.

Figure 9:
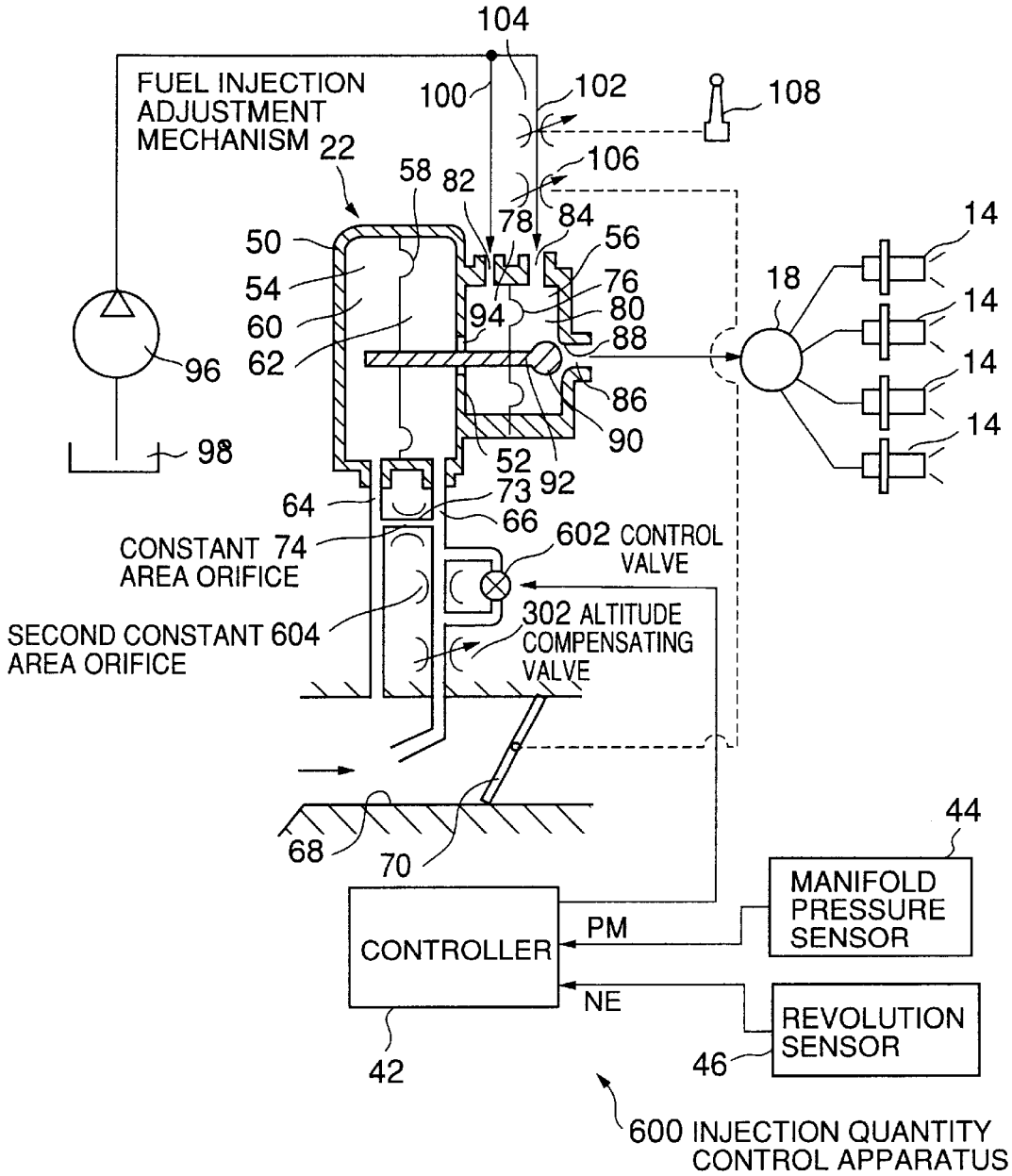
FIG. 9 is a diagram showing a structure of an injection quantity control apparatus of a sixth embodiment of the present invention.

FIG. 9 is a diagram showing a structure of an injection quantity control apparatus 600 of the present embodiment. The injection quantity control apparatus 600 is achieved by providing a control valve 602 and a second constant area orifice 604 in parallel with each other instead of the control valve 402 in the injection quantity control apparatus 400 of the fourth embodiment shown in FIG. 7. The control valve 602 is an ON/OFF solenoid valve which is opened (or closed) in a regular state and closed (or opened) when an ON signal is supplied from the controller 42. In FIG. 9, parts that are the same as the parts shown in FIG. 7 are given the same reference numerals, and descriptions thereof will be omitted.

In the present embodiment, the dynamic pressure $\Delta P_1$ between the pressure $P_I$ of the static pressure chamber 60 and the pressure $P_{II}$ of the total pressure chamber 62 in a state where the control valve 602 is opened is expressed by the following equation.

$$\Delta P_1=\Delta P_{1,3}=(P_1-P_0)\cdot R_1/(R_1+R_3)$$

Thus, the flow rate Q is expressed by the following equation.

$$Q=Q_3=[R_1/\{R\cdot(R_1+R_3)\}]\cdot(C_1/C_2)\cdot\rho\cdot v^2/2$$

When a flow resistance of the second constant area orifice 604 is represented by $R_7$, the dynamic pressure $\Delta P_1$ in a state where the control valve 602 is closed is expressed by the following equation.

$$\Delta P_1=\Delta P_{1,4}=(P_1-P_0)\cdot R_1/(R_1+R_3+R_7)$$

In this case, the flow rate Q is expressed by the following equation.

$$Q=Q_4=[R_1/\{R\cdot(R_1+R_3+R_7)\}]\cdot(C_1/C_2)\cdot\rho\cdot v^2/2$$

Thus, in the present embodiment, the flow rate Q can be switched between $Q_3$ and $Q_4$ ($Q_4<Q_3$) in accordance with a closed/open state of the control valve 602.

In the present embodiment, the controller 42 closes the control 602 to achieve the flow rate $Q_4$ when it is determined that a desired lean air-fuel ratio can be achieved with the flow rate $Q_4$ based on a specific volume of intake air calculated from the intake manifold pressure PM and the engine speed NE. Thus, according to the present embodiment, the pilot can achieve the lean air-fuel ratio without operating the mixture lever 108.

Additionally, in the present embodiment, since the control valve 602 and the second constant area orifice 604 are provided in parallel, the dynamic pressure $\Delta P_1$ is generated in accordance with the flow resistance $R_7$ of the second constant area orifice 604 when the control valve 602 is closed. Thus, if the control valve 602 is fixed to be closed due to a failure, the flow rate Q can be maintained equal to or greater than $Q_4$. Additionally, if the control valve 502 is fixed to be opened due to a failure, the flow rate Q can be maintained equal to or smaller than $Q_3$. As mentioned above, the flow rate $Q_4$ is set to be a value with which the lean air-fuel ratio can be achieved. Additionally, the flow rate $Q_3$ is a flow rate determined by an original property of the fuel quantity adjustment mechanism 22. Therefore, according to the injection quantity control apparatus 600 of the present embodiment, it is possible to prevent an air-fuel ratio from being excessively rich or lean since the flow rate Q is maintained between $Q_3$ and $Q_4$ when the control valve 502 is fixed to be closed or opened due to a failure. Thus, the injection quantity control apparatus 600 has a high fail-safe performance against a failure of the control valve 602.

In the above-mentioned sixth embodiment, the injection quantity is switched between two levels by the control valve 602 constituted as an ON/OFF solenoid valve. However, it is also possible to use a linear solenoid valve as the control valve 602 so that the flow rate Q can be linearly changed between $Q_3$ and $Q_4$. In this case, the injection quantity is continuously controlled based on the intake manifold pressure PM and the engine speed NE as in the case of the above-mentioned first to fourth embodiments.

Additionally, although the second constant area orifice 604 and the control valve 602 are provided to the total pressure port 66 in the sixth embodiment, the second constant area orifice 604 and the control valve 602 may be provided to a part of the static pressure port 64 between the intake pipe 68 and the connecting passage 73. In this case, the dynamic pressure $\Delta P_1$ is expressed in the same way as in the case of the sixth embodiment, with the pressure $P_I$ of the static pressure chamber 60 changing in accordance with an opening of the control valve 602. Similarly, the altitude compensating valve 302 may be provided to the static pressure port 64.

Next, a description will be given of a seventh embodiment of the present invention.

Figure 10:
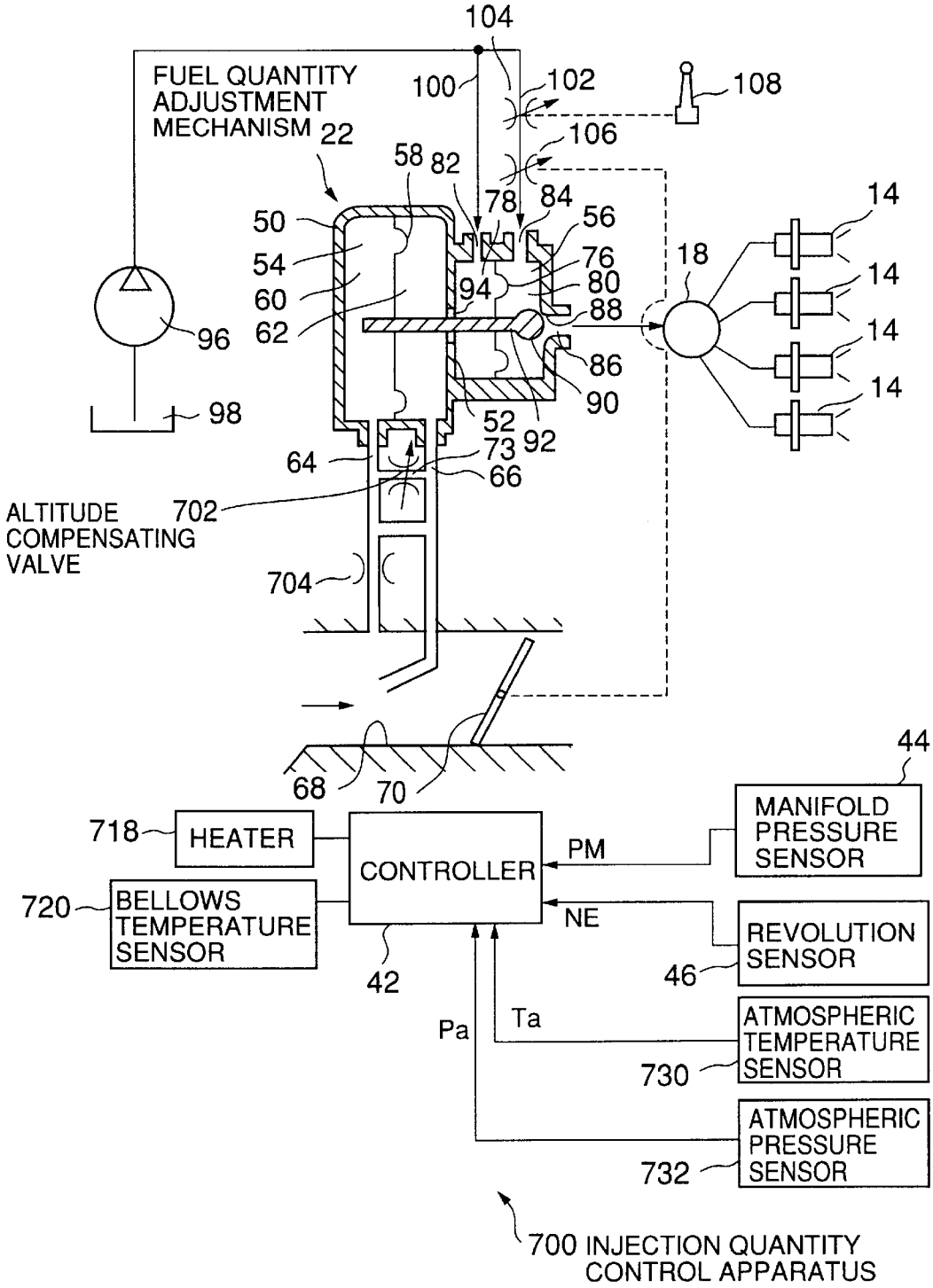
FIG. 10 is a diagram showing a structure of an injection quantity control apparatus of a seventh embodiment of the present invention.

FIG. 10 is a diagram showing a structure of the injection quantity control apparatus 700 of the present embodiment. The injection quantity control apparatus 700 can be achieved by omitting the control valve 72, replacing the constant area orifice 74 with an altitude compensating valve 702, providing a constant area orifice 704 to the static pressure port 64 at a position between the intake pipe 68 and the altitude compensating valve 702, and further providing a heater 718, a bellows temperature sensor 720, an atmospheric temperature sensor 730 and an atmospheric pressure sensor 732 in the injection quantity control apparatus 40 of the first embodiment.

The atmospheric temperature sensor 730 and the atmospheric pressure sensor 732 output signals to the controller 42 in accordance with an atmospheric temperature Ta and an atmospheric pressure Pa, respectively. The controller 42 detects the atmospheric temperature Ta and the atmospheric pressure Pa based on the output signals of these sensors.

Figure 11:
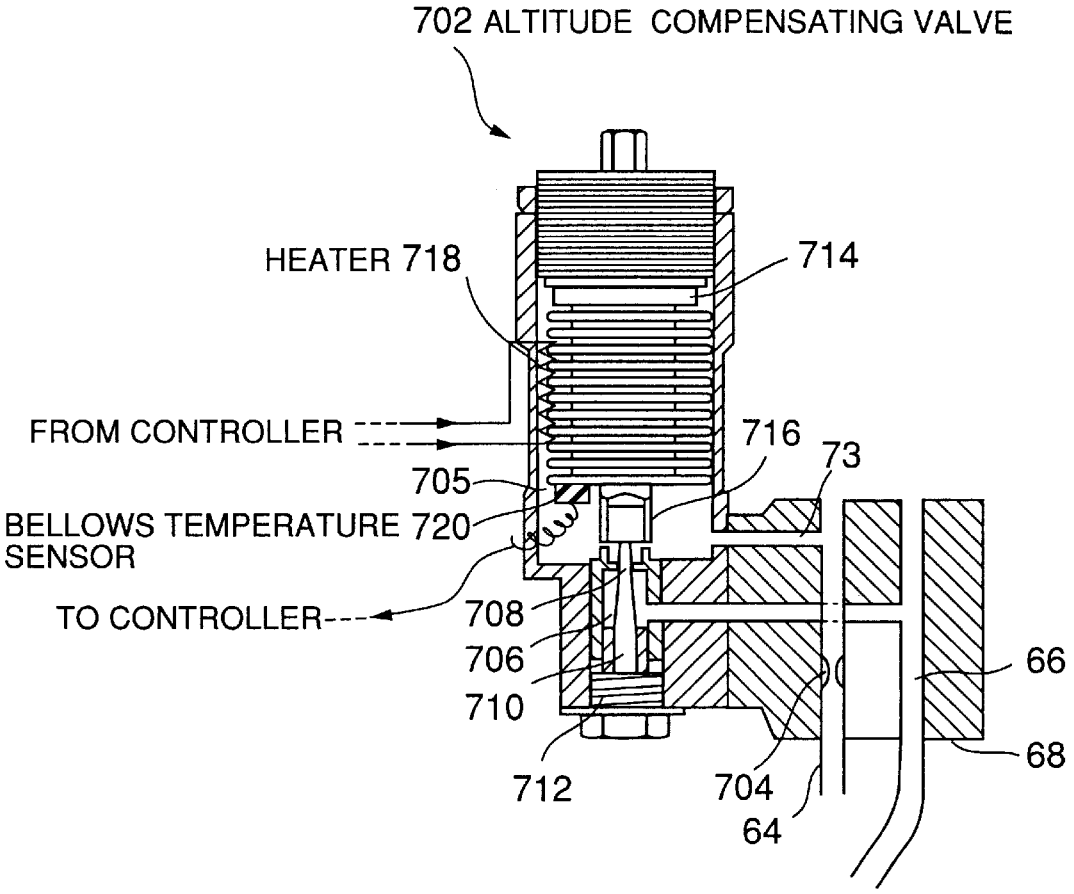
FIG. 11 is a diagram showing a structure of an altitude compensating valve provided to the injection quantity control apparatus of the seventh embodiment.

FIG. 11 is a diagram showing a structure of the altitude-compensating valve 702. As shown in FIG. 11, the altitude-compensating valve 702 includes a first chamber 705 and a second chamber 706 provided below the first chamber 705. The first chamber 705 is connected to the static pressure port 64, and the second chamber 706 is connected to the total pressure port 66. The first chamber 705 and the second chamber 706 are connected to each other via a circular orifice 708. A needle valve 708 extends through the orifice 708. The needle valve 708 has a tapered shape whose diameter decreases toward an upper end thereof. A lower end of the needle valve 710 is supported by a resilient member 712. The resilient member 712 can be resiliently deformed in a vertical direction in FIG. 11. Thus, the needle valve 710 moves in an axial direction thereof in accordance with a force which is exerted on the needle valve 710 in the axial direction.

The altitude-compensating valve 702 has a bellows 714 provided in the first chamber 705. The bellows 714 can expand and contract in a vertical direction in FIG. 11. A gas such as helium is sealed in the bellows 714. A pressing member 716 is fixed to a lower end face of the bellows 714. The pressing member 716 is in contact with an upper end of the needle valve 710.

According to the above-mentioned structure, when a density of the atmospheric air decreases, the bellows 714 expands to press down the needle valve 710 via the pressing member 716. As mentioned above, the diameter of the needle valve 710 decreases toward the upper end thereof. Thus, when the needle valve 710 is pressed down, an opening area of the orifice 708 increases. When an opening area of the orifice 708 increases, a flow resistance between the first chamber 705 and the second chamber 706, that is, a flow resistance between the total pressure chamber 66 and static pressure chamber 64, decreases. In this way, the altitude compensating valve 702 has a characteristic of decreasing a flow resistance thereof (that is, increasing an opening thereof) in accordance with a decrease in a density of the atmospheric air.

The total pressure chamber 62 of the fuel quantity adjustment mechanism 22 is directly supplied with the total pressure $P_1$ of the intake pipe 68. On the other hand, the static pressure chamber 60 is supplied with a pressure obtained, in part, by dividing the total pressure $P_1$ and the static pressure $P_0$ of the intake pipe 68 by a flow resistance $R_8$ of the altitude compensating valve 702 and a flow resistance $R_9$ of the constant area orifice 704. That is, the pressures $P_I$ and $P_{II}$ of the static pressure chamber 60 and the total pressure chamber 62 are expressed by the following equations (14) and (15).

$$P_I=P_0+(P_1-P_0)\cdot R_9/(R_8+R_9) \quad (14)$$

$$P_{II}+P_1 \quad (15)$$

Thus, the dynamic pressure $\Delta P_1$ between the pressure $P_I$ of the static pressure chamber 60 and the pressure $P_{II}$ of the total pressure chamber 62 is expressed by the following equation (16).

$$\Delta P_1=P_{II}-P_I=(P_1-P_0)\cdot R_9/(R_8+R_9) \quad (16)$$

As mentioned above, the flow resistance $R_8$ of the altitude compensating valve 702 decreases in accordance with a decrease in a density of the atmospheric air. As seen from the equation (16), when the flow resistance $R_8$ decreases, the dynamic pressure $\Delta P_1$ decreases. Additionally, when the dynamic pressure $\Delta P_1$ decreases, the flow rate Q of fuel delivered from the fuel quantity adjustment mechanism 22 decreases. As mentioned above, the fuel quantity adjustment mechanism 22 has a characteristic of increasing the flow rate Q relative to a specific volume of intake air in accordance with a decrease in a density of the atmospheric air when the altitude of the aircraft becomes high. Thus, the altitude compensating valve 702 of the present embodiment can compensate for an increase of the injection quantity due to a decrease in a density of intake air.

As shown in FIG. 11, the heater 718 is mounted to the bellows 714 of the altitude compensating valve 702. The heater 718 heats the bellows 714 in accordance with a current supplied from the controller 42. The bellows temperature sensor 720 is also mounted to the bellows 714. The bellows temperature sensor 720 outputs a signal to the controller 42 in accordance with a temperature of the bellows 714 (hereinafter referred to as a bellows temperature T). The controller 42 detects the bellows temperature T based on the output signal of the bellows temperature sensor 720.

When the bellows 714 is heated by the heater 718, the bellows 714 expands due to a thermal expansion of the gas sealed in the bellows 714. As mentioned above, when the bellow 714 expands, the flow resistance $R_8$ of the altitude compensating valve 702 decreases since the needle valve 710 is pressed down. When the flow resistance $R_8$ decreases, the flow rate Q decreases. Thus, according to the present embodiment, the injection quantity can be controlled by changing a temperature of the bellows 714 heated by the heater 718. The injection quantity control apparatus 700 of the present embodiment controls the injection quantity so that the target air-fuel ratio $A_c$ is achieved by changing a current supplied to the heater 718 from the controller 42.

Figure 12:
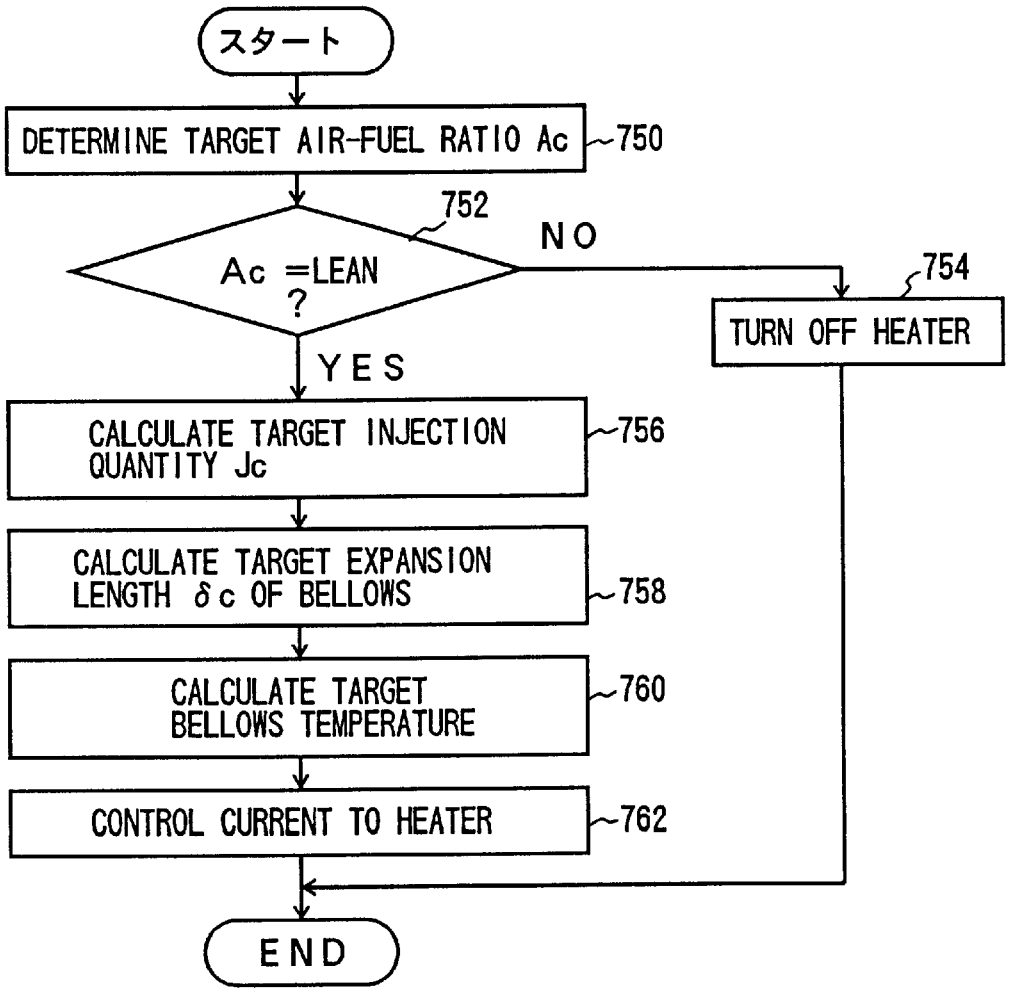
FIG. 12 is a flowchart performed by a controller so as to control an injection quantity in the seventh embodiment.

FIG. 12 is a flowchart of a control routine performed by the controller 42 so as to control the injection quantity in the above-mentioned manner. When the routine shown in FIG. 12 is started, the process of step 750 is performed first.

In step 750, the target air-fuel ratio $A_c$ is determined. In the present embodiment, the target air-fuel ratio $A_c$ is set to be either rich or lean. The target air-fuel ratio $A_c$ may be set by the pilot through an operating panel.

In step 752, it is determined whether or not the target air-fuel ratio $A_c$ is lean. If the target air-fuel ratio $A_c$ is not lean (that is, if $A_c$ is rich), then a current supplied to the heater 718 is cut off in step 754. When the process of step 754 is finished, then the present routine is ended. On the other hand, if the target air-fuel ratio $A_c$ is lean in step 752, then the target injection quantity $J_c$ to achieve the target air-fuel ratio $A_c$ is calculated in step 756. Specifically, the controller 42 contains a map representing the injection quantity in relation to the air-fuel ratio, the atmospheric pressure Pa, the atmospheric temperature Ta, the intake manifold pressure PM and the engine speed NE, and calculates the target injection quantity $J_c$ by referring to the map in step 756. When the process of step 756 is finished, then the process of step 758 is performed.

In step 758, a target expansion length $\delta_c$ of the bellows 714 is calculated.

In step 760, a target bellows temperature to which causes a thermal expansion of the bellows 714 by the target expansion length $\delta_c$ is calculated. Specifically, the target bellows temperature $T_c$ is calculated based on the atmospheric temperature Ta and the atmospheric pressure Pa in accordance with the following equation:

$$T_c=\alpha\cdot Pa\cdot\delta_c+T0$$

where $\alpha$ is a constant determined in accordance with a property of the bellows 714.

In step 762, a current supplied to the heater 718 is feedback-controlled based on the bellows temperature T so that the bellows temperature T is set to be the target bellows temperature $T_c$. When the process of step 762 is finished, the present routine is ended.

As mentioned above, the injection quantity is controlled so that the target air-fuel ratio is achieved based on a current supplied to the heater 718. Thus, according to the injection quantity control apparatus 700 of the present embodiment, the pilot can achieve a desired air-fuel ratio without operating the mixture lever 108 while the aircraft is in flight.

Additionally, when the bellows 714 cannot be heated due to a failure of the heater 718 such as a cutoff, the injection quantity can be prevented from being excessively large or small by an original function of the altitude compensating valve 702 (that is, a function of the altitude compensating valve 702 in a state where the heater 718 is not provided). In this sense, the injection quantity control apparatus 700 of the present embodiment has a high fail-safe performance against a failure of the heater 718.

In the above-mentioned seventh embodiment, the target expansion length $\delta_c$ of the bellows 714 to achieve the lean air-fuel ratio is determined based on the parameters such as the intake manifold pressure PM. However, the target expansion length $\delta_c$ may be a fixed value.

Next, a description will be given of an eighth embodiment of the present invention. An injection quantity control apparatus of the present embodiment is achieved by the controller 42 performing a control routine shown in FIG. 13 instead of the control routine shown FIG. 12 in the system shown in FIGS. 10 and 11 of the seventh embodiment. In the present embodiment, an air-fuel ratio sensor (an $O_2$ sensor, for example) which outputs a signal in accordance with the air-fuel ratio is connected to the controller 42. The controller 42 detects the actual air-fuel ratio based on the output signal of the air-fuel ratio sensor.

Figure 13:
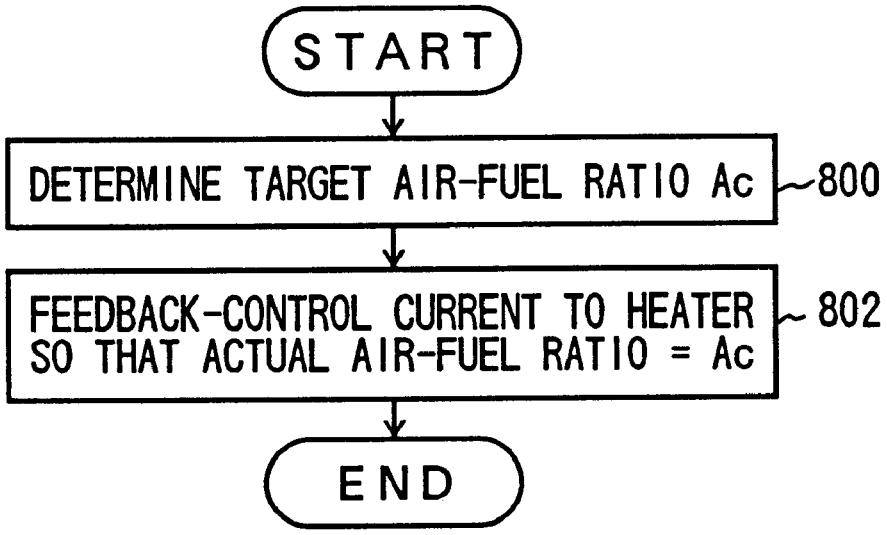
FIG. 13 is a flowchart performed by a controller so as to control an injection quantity in an eighth embodiment of the present invention.

When the routine shown in FIG. 13 is started, the process of step 800 is performed first. In step 800, the target air-fuel ratio $A_c$ is determined. In the present embodiment, the target air-fuel ratio $A_c$ is set to be a continuous real value.

In step 802, a current supplied to the heater 718 is feedback-controlled based on the actual air-fuel ratio detected by the air-fuel ratio sensor so that the actual air-fuel ratio is maintained to be the target air-fuel ratio $A_c$. When the process of step 802 is finished, the present routine is ended.

As mentioned above, in the present embodiment, the target air-fuel ratio $A_c$ is set to be a continuous value, and a current supplied to the heater 718 is feedback-controlled based on the actual air-fuel ratio so that the actual air-fuel ratio is maintained to be the target air-fuel ratio $A_c$. Thus, according to the injection quantity control apparatus of the present embodiment, a desired air-fuel ratio can be achieved with further high accuracy.

In the above-mentioned seventh and eighth embodiments, the bellows temperature T is detected based on the output signal of the bellows sensor 72 which is mounted to the bellows 714. However, since a resistance of the heater 718 changes in accordance with a temperature, the bellows temperature T may be detected based on the resistance of the heater 718 which is calculated from a voltage and a current of the heater 718.

Additionally, if a transistor is used as the heater 718, the bellows temperature T may be detected based on a base-emitter voltage since the base-emitter voltage changes in accordance with a temperature.

Although the orifice 704 is provided to the static pressure port 64 in the seventh and eighth embodiments, the orifice 704 may be provided to the total pressure port 66 at a part between the connecting passage 73 and the intake pipe 68. In this case, the dynamic pressure $\Delta P_1$ is expressed by the above-mentioned equation (16) as in the case of the seventh and eighth embodiment, with the pressure $P_H$ of the total pressure chamber 62 changing in accordance with an opening of the altitude compensating valve 702.

Next, a description will be given of a ninth embodiment of the present invention.

Figure 14:
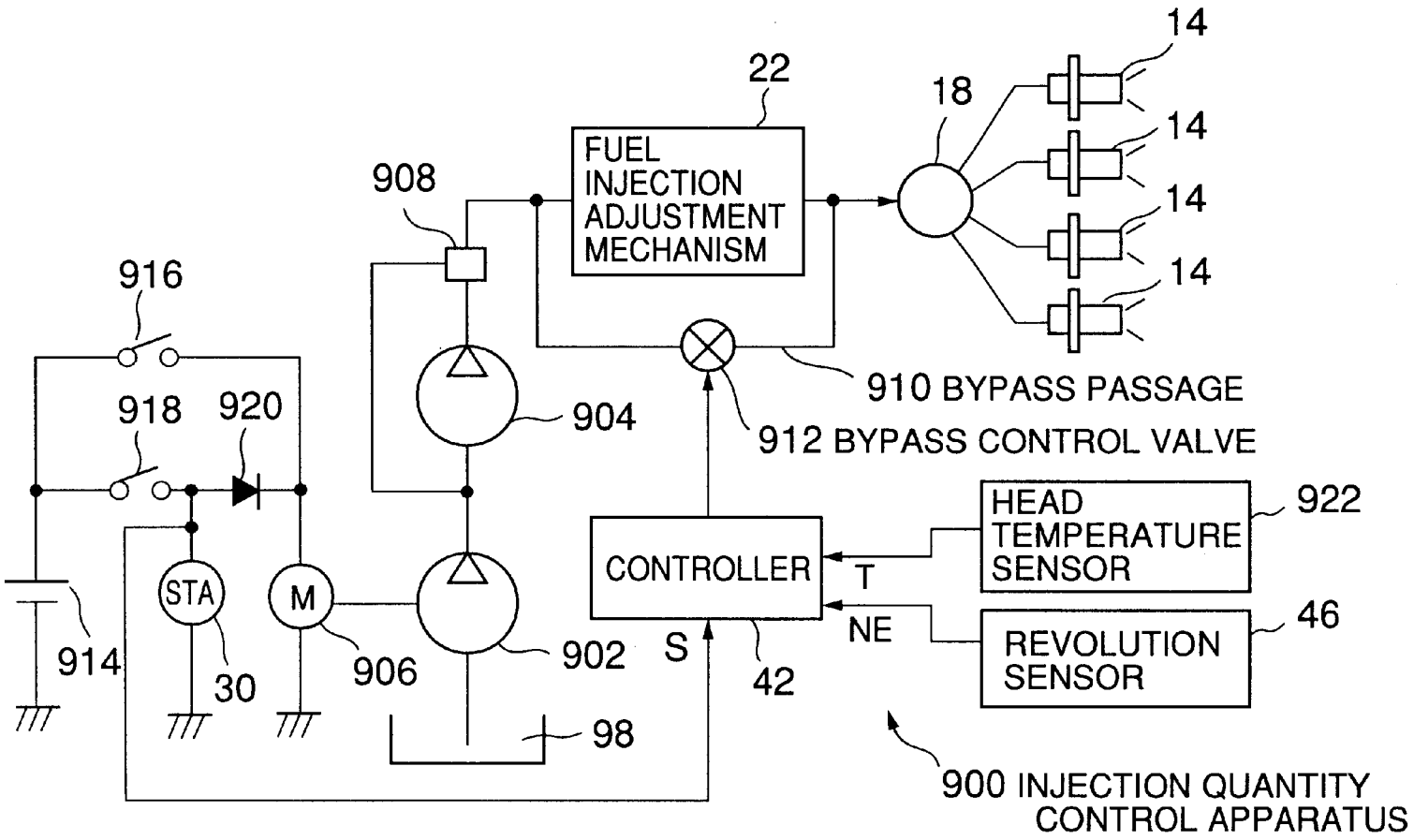
FIG. 14 is a diagram showing a structure of an injection quantity control apparatus of a ninth embodiment of the present invention.

FIG. 14 is a diagram showing a system structure of an injection quantity control apparatus 900 of the present embodiment. In FIG. 14, parts that are the same as the parts shown in FIG. 2 are given the same reference numerals, and descriptions thereof will be omitted. As shown in FIG. 14, the injection quantity control apparatus 900 includes an electric fuel pump 902 and a mechanical fuel pump 904. The electric fuel pump 902, which is actuated by a motor 906, pumps up fuel in the fuel tank 98 to an inlet port of the mechanical fuel pump 904. The mechanical fuel pump 904, which is actuated by using a rotation of an output shaft of the engine 10 as a power source, pressurizes the fuel discharged by the electric fuel pump 902 and supplies the fuel to the fuel quantity adjustment mechanism 22. A regulator 908 is provided to a discharge port of the mechanical fuel pump 904. The regulator 908 returns the fuel discharged by the mechanical fuel pump 904 to the inlet port thereof when a discharge pressure of the mechanical fuel pump 904 exceeds a predetermined value. Thus, the supplied oil pressure $P_P$ to the fuel quantity adjustment mechanism 22 is maintained to be the predetermined value. However, the regulator 908 may be omitted so that the discharge pressure of the mechanical fuel pump 904 is directly supplied to the fuel quantity adjustment mechanism 22. The fuel quantity adjustment mechanism 22 adjusts an amount of fuel delivered to the flow divider 18.

The injection quantity control apparatus 900 includes a bypass passage 910 which bypasses the fuel quantity adjustment mechanism 22. A bypass control valve 912 is provided to the bypass passage 910. The bypass control valve 912 is a linear solenoid valve which linearly changes an opening thereof in accordance with a control signal supplied from the controller 42. Thus, the flow divider 18 is supplied with fuel via the bypass passage 58 with a flow rate corresponding to an opening of the bypass control valve 912, in addition to the fuel delivered from the fuel quantity adjustment mechanism 22.

The motor 906 and the starter 30 are connected to a battery 914 via a fuel pump switch 916 and a starter switch 918, respectively. A diode 920 is connected between a power supply terminal of the motor 906 and a power supply terminal of the starter 30 so that only a flow of current from the starter 30 to the motor 906 is permitted. Thus, when the starter switch 918 is turned on, the starter 30 and the electric fuel pump 902 are started at the same time. On the other hand, when the fuel pump switch 916 is turned on, only the electric fuel pump 902 is started.

The power supply terminal of the starter 30 is connected to the controller 42. The controller 42 determines whether or not the starter 30 is turned on based on a voltage at the power supply terminal of the starter 30 (hereinafter referred to as a starter voltage S).

A head temperature sensor 922 is connected to the controller 42. The head temperature sensor 922 outputs a signal in accordance with a temperature of a cylinder head of the engine 10 (hereinafter referred to as a head temperature $T_H$). The controller 42 detects the head temperature $T_H$ based on the output signal of the head temperature sensor 922.

It should be noted that, in the present and the following embodiments, no orifice or valve is provided to the static pressure port 64 or the total pressure port 66. Thus, the pressure $P_I$ of the static pressure chamber 60 is maintained equal to the static pressure $P_0$ of the intake pipe 68, and the pressure $P_H$ of the dynamic pressure chamber 62 is maintained equal to the total pressure $P_1$ of the intake pipe 68. Accordingly, the dynamic pressure $\Delta P_1$ between the pressure $P_I$ of the static pressure chamber 60 and the pressure $P_H$ of the total pressure chamber 62 is equal to the dynamic pressure between the static pressure $P_0$ and the total pressure $P_1$.

When the engine 10 is started, since a temperature of the engine 10 is low, fuel injected by the injection nozzle 14 is not easily vaporized. Additionally, when the engine 10 is started, since a specific volume of intake air is small, an appropriate injection quantity cannot be achieved by only adjusting the injection quantity in accordance with the specific volume of intake air. However, the fuel quantity adjustment mechanism 22 regulates a flow rate of fuel which is delivered therefrom in accordance with the specific volume of intake air. Thus, if the injection quantity is regulated only by the fuel quantity adjustment mechanism 22, the pilot is required to adjust the injection quantity by operating the mixture lever 108 when the engine 10 is started. Such an operation forces a burden on the pilot since the pilot has to perform the above operation while monitoring operating states of the engine 10 such as the engine speed NE. Thus, the pilot is required to be highly skilled.

The injection quantity control apparatus 900 of the present embodiment can reduce a burden forced on the pilot by automatically controlling the injection quantity when the engine 10 is started.

Figure 15:
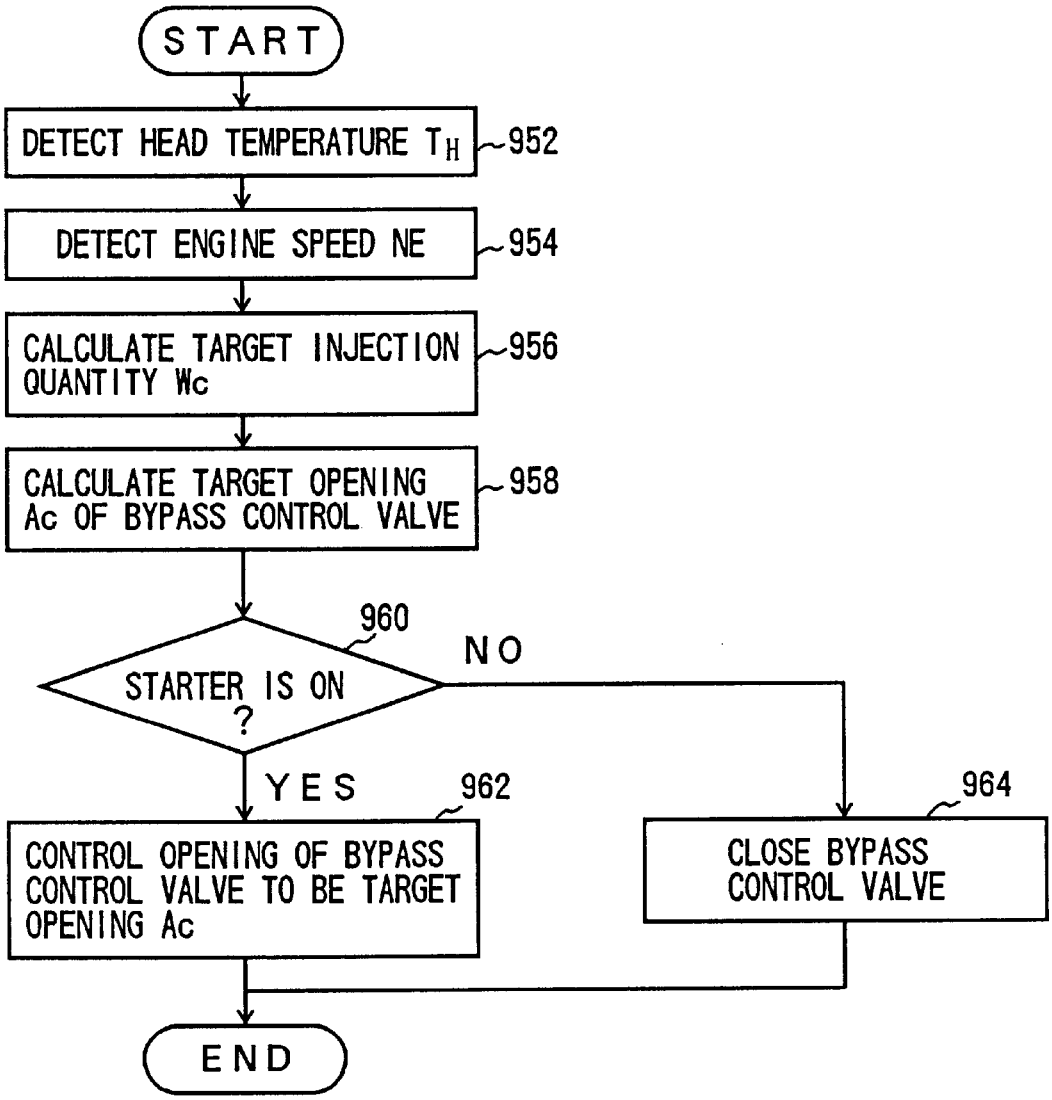
FIG. 15 is a flowchart performed by a controller so as to control an injection quantity when the engine is started in the ninth embodiment of the present invention.

FIG. 15 shows a flowchart of a control routine performed by the controller 42 so as to control the injection quantity when the engine 10 is started in the present embodiment. The routine shown in FIG. 15 is repeatedly performed every time when one process cycle thereof is finished. When the routine is started, the process of step 952 is performed.

In step 952, the head temperature $T_H$ is detected based on the output signal of the head temperature sensor 922.

In step 954, the engine speed NE is detected based on the output signal of the revolution sensor 46.

In step 956, a target injection quantity $W_c$ is determined based on the head temperature $T_H$ and the engine speed NE.

As a temperature become lower, the injection quantity must be increased since fuel is less easily vaporized. Additionally, the injection quantity must be changed in accordance with the engine speed NE since the specific volume of intake air per one cycle of the engine 10 changes in accordance with the engine speed NE. Thus, a required injection quantity changes in accordance with the head temperature $T_H$ and the engine speed NE. A representation of the optimal injection quantity in relation to the head temperature $T_H$ and the engine speed NE, which is experimentally predetermined, is stored in the controller 42 as a map or an experimental equation. The controller 42 calculates the target injection quantity $W_c$ by referring to the map or the experimental equation in step 954.

In step 958, a target opening $A_c$ of the bypass control valve 912 with which the target injection quantity $W_c$ is achieved is calculated.

In step 960, it is determined whether or not the starter 30 is turned on based on the starter voltage S. If the starter 30 turned on, it is judged that the engine 10 is being started. In this case, an opening of the bypass control valve 912 is controlled to be the target opening $A_c$ in step 962. As mentioned above, when the starter 30 is turned on, the electric fuel pump 902 is turned on at the same time. Thus, according to the process of step 962, fuel is injected by the injection nozzle 14 with the target injection quantity $W_c$. When the process of step 962 is finished, the present routine is ended.

On the other hand, if the starter 30 is not turned on in step 960, it is judged that the engine 10 is not being started. In this case, the bypass control valve 912 is closed in step 964. According to the process of step 960, only fuel delivered by the fuel quantity adjustment mechanism 22 is injected by the injection nozzle 14 since the bypass passage 910 is shut off by the bypass control valve 912. When the process of step 964 is finished, then the present routine is ended.

As mentioned above, fuel can be injected with the proper injection quantity in accordance with the head temperature $T_H$ and the engine speed NE when the engine 10 is started by the controller 42 performing the above-mentioned routine shown in FIG. 15 in the present embodiment. Thus, according to the present embodiment, the pilot need not manually adjust the injection quantity by operating the mixture lever 108 when the engine 10 is started. Additionally, since the electric fuel pump 906 is started in association with an operation of the starter switch 918, the pilot need not operate the fuel pump switch 916. Thus, according to the injection quantity control apparatus 900 of the present embodiment, it is possible to reduce a burden forced on the pilot when the engine 10 is started.

In the above-mentioned embodiment, the bypass control valve 912 is constructed as a linear valve which linearly changes an opening thereof. However, the bypass control valve 912 may be constructed as an ON/OFF valve. In this case, the injection quantity can be controlled by a duty-control of the ON/OFF valve.

Next, a description will be given of a tenth embodiment of the present invention.

Figure 16:
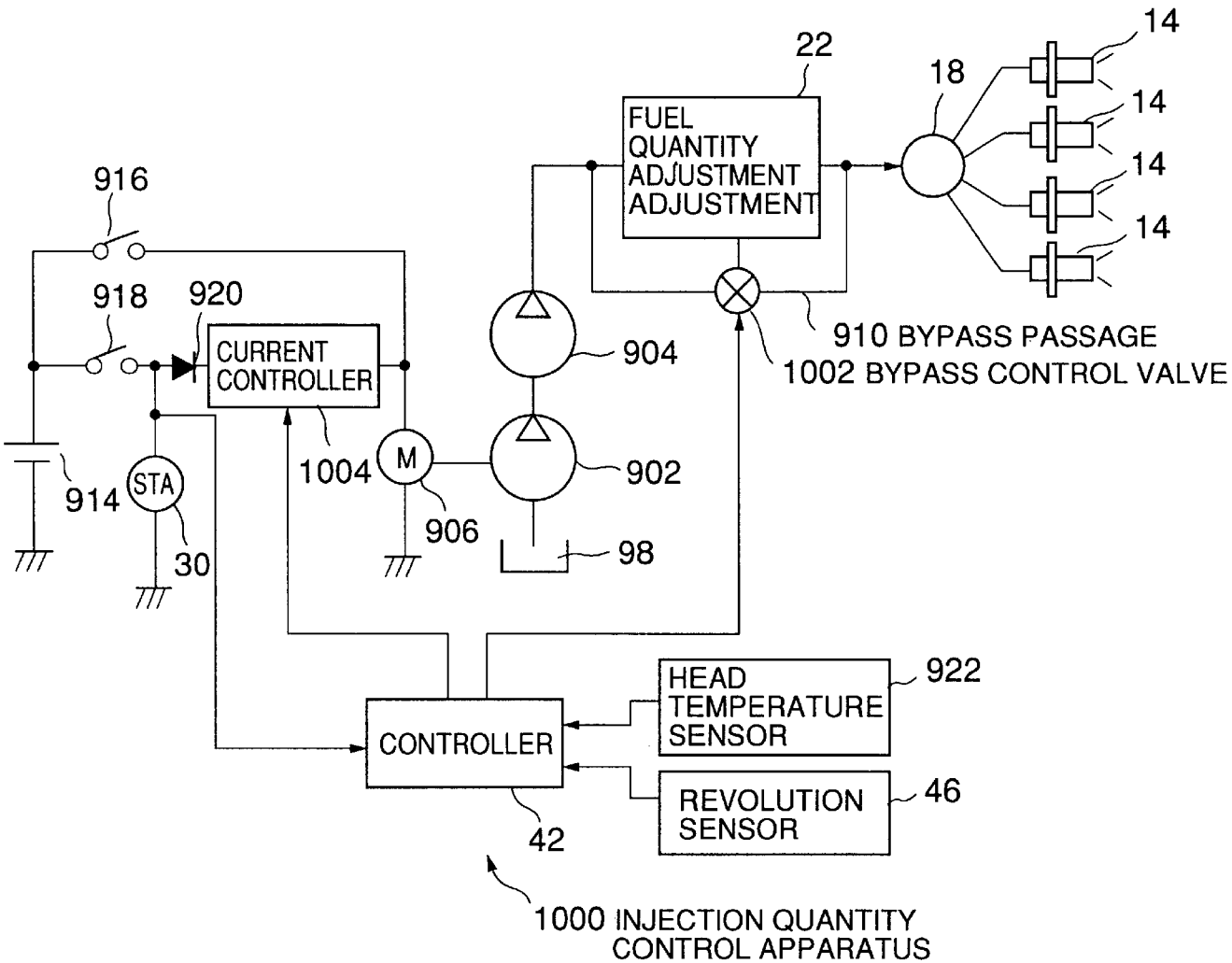
FIG. 16 is a diagram showing a structure of an injection quantity control apparatus of a tenth embodiment of the present invention.

FIG. 16 is a diagram showing a structure of an injection quantity control apparatus 1000 of the present embodiment. In FIG. 16, parts that are the same as the parts shown in FIG. 14 are given the same reference numerals, and descriptions thereof will be omitted.

As shown in FIG. 16, the injection quantity control apparatus 1000 of the present embodiment includes a bypass control valve 1002 instead of the bypass control valve 912 of the tenth embodiment. The bypass control valve 1002 is an ON/OFF valve which is closed in a regular state and opened when an ON signal is supplied from the controller 42.

The injection quantity control apparatus 1000 also includes a current controller 1004. The current controller 1004 is connected between the diode 920 and the power supply terminal of the motor 906. The current controller 1004 linearly changes a current supplied to the motor 906 in accordance with a control signal supplied from the controller 42 in a situation where the starter switch 918 is turned on. The motor 906 generates a torque which is substantially proportional to the current supplied from the current controller 1004. The electric fuel pump 902 discharges fuel to the mechanical fuel pump 904 with a pressure which is substantially proportional to the torque generated by the motor 906. When the pump switch 916 is turned on, the motor 906 is actuated with a maximum torque thereof irrespective of a state of the current controller 1004.

The mechanical fuel pump 904 pressurizes the fuel discharged by the electric fuel pump 902 by a predetermined pressure. In the present embodiment, the regulator 908 of the tenth embodiment is not provided at the discharge port of the mechanical fuel pump 904. Thus, the supplied fuel pressure $P_P$ can be linearly controlled based on the control current supplied to the current controller 1004 from the controller 42.

As mentioned above, the fuel quantity adjustment mechanism 22 delivers fuel to the flow divider 18 with a flow rate Q in accordance with a specific volume of intake air, irrespective of a value of the supplied fuel pressure $P_P$. Additionally, in a state where the bypass control valve 1002 is opened, the flow divider 18 is supplied with fuel with a flow rate which is substantially proportional to the supplied fuel pressure $P_P$ via the bypass passage 910. Thus, the injection quantity control apparatus 1000 of the present embodiment controls the injection quantity by changing the supplied fuel pressure $P_P$ based on a current supplied to the motor 906 while maintaining the bypass control valve 1002 to be opened when the engine 10 is started.

Figure 17:
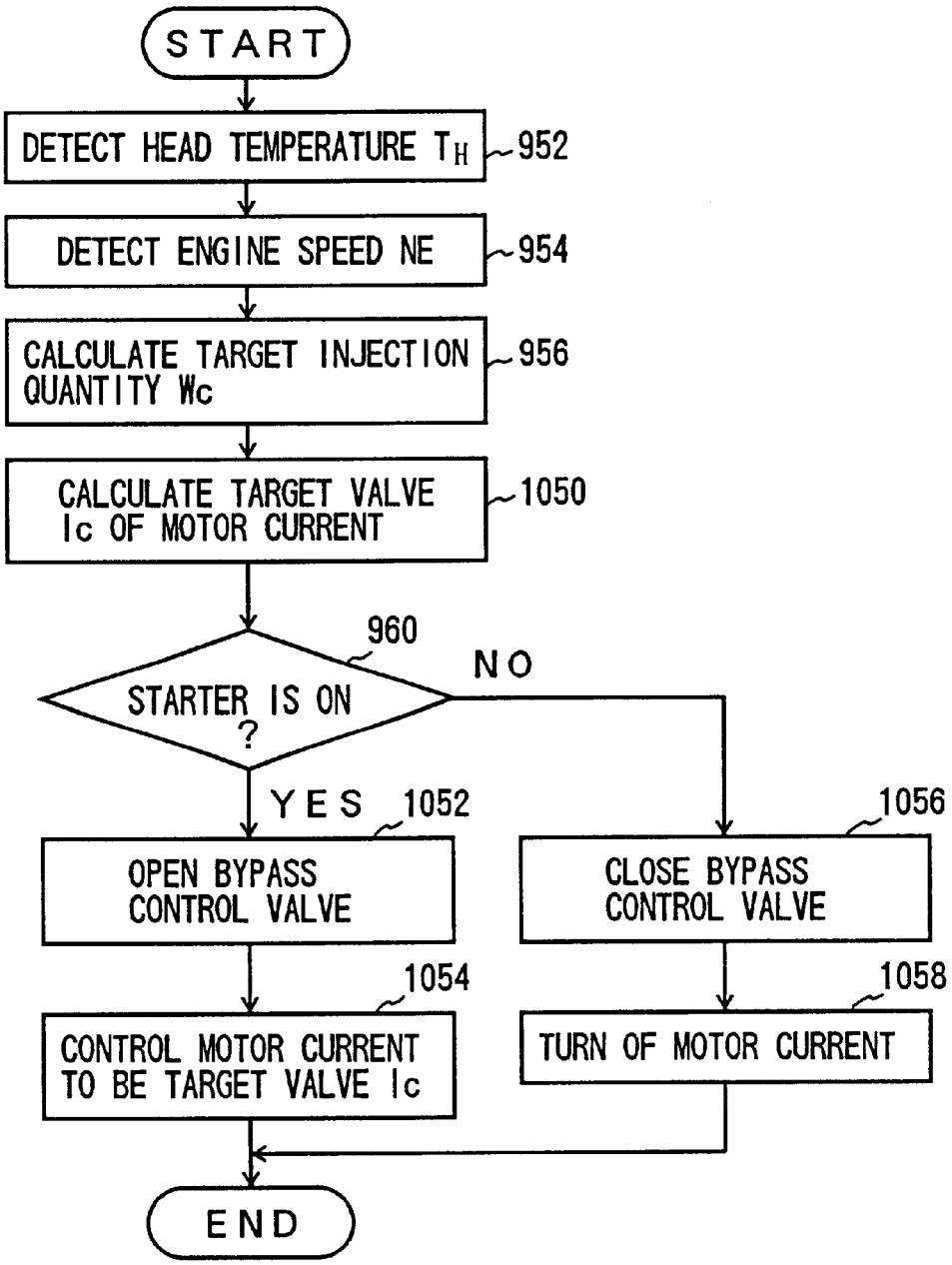
FIG. 17 is a flowchart performed by a controller so as to control an injection quantity when the engine is started in the tenth embodiment of the present invention.

FIG. 17 shows a flowchart of a control routine performed by the controller 42 so as to control the injection quantity when the engine 10 is started in the present embodiment. The routine shown in FIG. 17 is repeatedly started every time when one process cycle thereof is finished. In FIG. 17, steps in which the same processes are performed as those of steps shown in FIG. 15 are given the same numerals, and descriptions thereof will be omitted.

In the routine shown in FIG. 17, after the target injection quantity $W_c$ is calculated based on the head temperature $T_H$ and the engine speed NE in step 956, the process of step 1050 is performed. In step 1050, a target value $I_c$ of a current to be supplied to the motor 906 so as to achieve the target injection quantity $W_c$ is calculated.

In the subsequent step 960 subsequent to step 1050, it is determined whether or not the starter 30 is turned on. If the starter 30 is turned on, the bypass control valve 1002 is opened in step 1052, and then a control signal is supplied to the current controller 1004 so that a current supplied to the motor 906 is maintained to be the target value $I_c$ in step 1054. On the other hand, if the starter 30 is not turned on in step 960, the bypass control valve 1002 is closed, and then a current supplied to the motor 54 from the current controller 1004 is set to be zero in step 1058. When the process of step 1054 or 1058 is finished, then the present routine is ended.

As mentioned above, the injection quantity can be controlled based on a current supplied to the motor 906 from the current controller 1004 when the engine 10 is started by the controller 42 performing the routine shown in FIG. 17. Thus, according to the present embodiment, the pilot need not manually adjust the injection quantity by operating the mixture lever 108 or operate the fuel pump switch 916 when the engine 10 is started. Thus, it is possible to reduce a burden forced on the pilot.

Additionally, since the bypass control valve 1002 constituted as an ON/OFF valve is used instead of the bypass control valve 912 constructed as a linear solenoid valve of the tenth embodiment, a cost of the system can be reduced in the present embodiment.

Next, a description will be given of an eleventh embodiment of the present invention.

Figure 18:
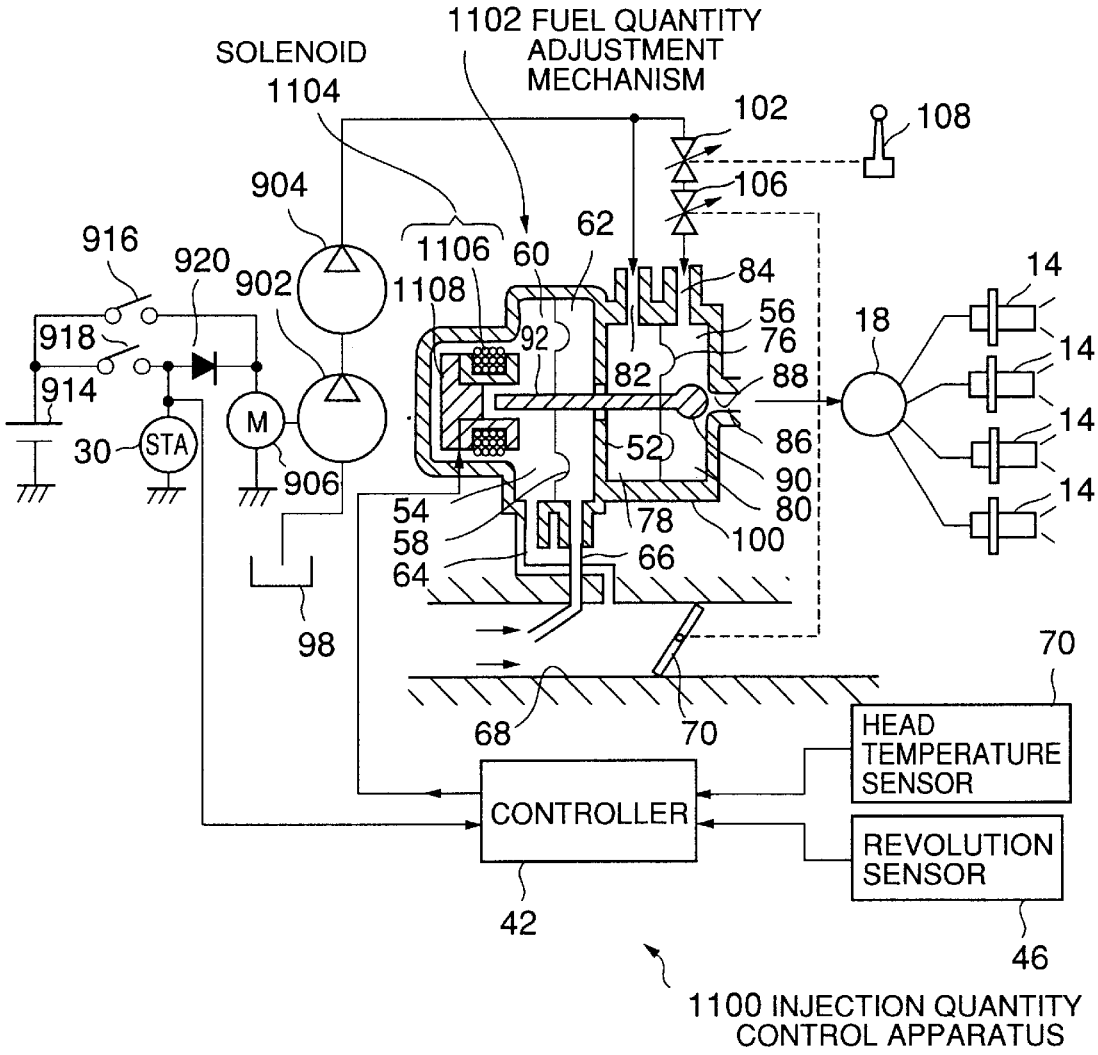
FIG. 18 is a diagram showing a structure of an injection quantity control apparatus of an eleventh embodiment of the present invention.

FIG. 18 is a diagram showing a structure of an injection quantity control apparatus 1100. In FIG. 18, parts that are the same as the parts shown in FIG. 2 or FIG. 14 are given the same reference numerals, and descriptions thereof will be omitted.

As shown in FIG. 18, the injection quantity control apparatus 1100 is achieved by providing a fuel quantity adjustment mechanism 1102 instead of the fuel quantity adjustment mechanism 22 and omitting the bypass passage 910 and the bypass control valve 912 in the injection quantity control apparatus 900 of the tenth embodiment.

The fuel quantity adjustment mechanism 302 includes a solenoid 1104. The solenoid 304 comprises a coil 1106 and a core 1108. The coil 1106 is provided so as to surround a left end part of the valve shaft 92 in FIG. 18. The coil 1106 is connected to the controller 42. The controller 42 supplies an exciting current to the coil 1106. The core 1108 is made of a magnetic material. The core 1108 is inserted into the coil 1106 from the left in FIG. 18 so that the core 1108 faces a left end face of the valve shaft 92 with a predetermined clearance being therebetween. In the present embodiment, the valve shaft 92 is made of a magnetic material.

According to the above-mentioned structure of the solenoid 1104, an electromagnetic attracting force is exerted between the core 1108 and the valve shaft 92 in accordance with an amplitude of the exciting current supplied to the coil 1106. This electromagnetic attracting force is transmitted to the ball valve 90 as a force Fe in the valve opening direction. As mentioned above, the force $F_1$ ($=C_1\cdot\Delta P_1=C_1\cdot\rho\cdot v^2/2$) in the valve opening direction and the force $F_2$ ($=C_2\cdot R\cdot Q$) in the valve closing direction are exerted on the ball valve 90. In the present embodiment, since the force Fe in the valve opening direction is exerted on the ball valve 90 in addition to the forces $F_1$ and $F_2$, the following equation (17) is obtained from a balance of the forces $F_1$, $F_2$ and Fe.

$$C_1\cdot v^2/2+F_e=C_2\cdot R\cdot Q \tag{17}$$

The following equation (18) is derived from the equation (17).

$$Q=(1/R)\cdot(C_1/C_2)\cdot\rho\cdot v^2/2+F_e/(C_2\cdot R) \tag{18}$$

As seen from the equation (18), the flow rate Q of fuel delivered from the fuel quantity adjustment mechanism 1102 increases as the force Fe becomes larger. The injection quantity control apparatus 1100 of the present embodiment controls the injection quantity by changing the exciting current supplied to the coil 306 from the controller 42 when the engine 10 is started.

Figure 19:
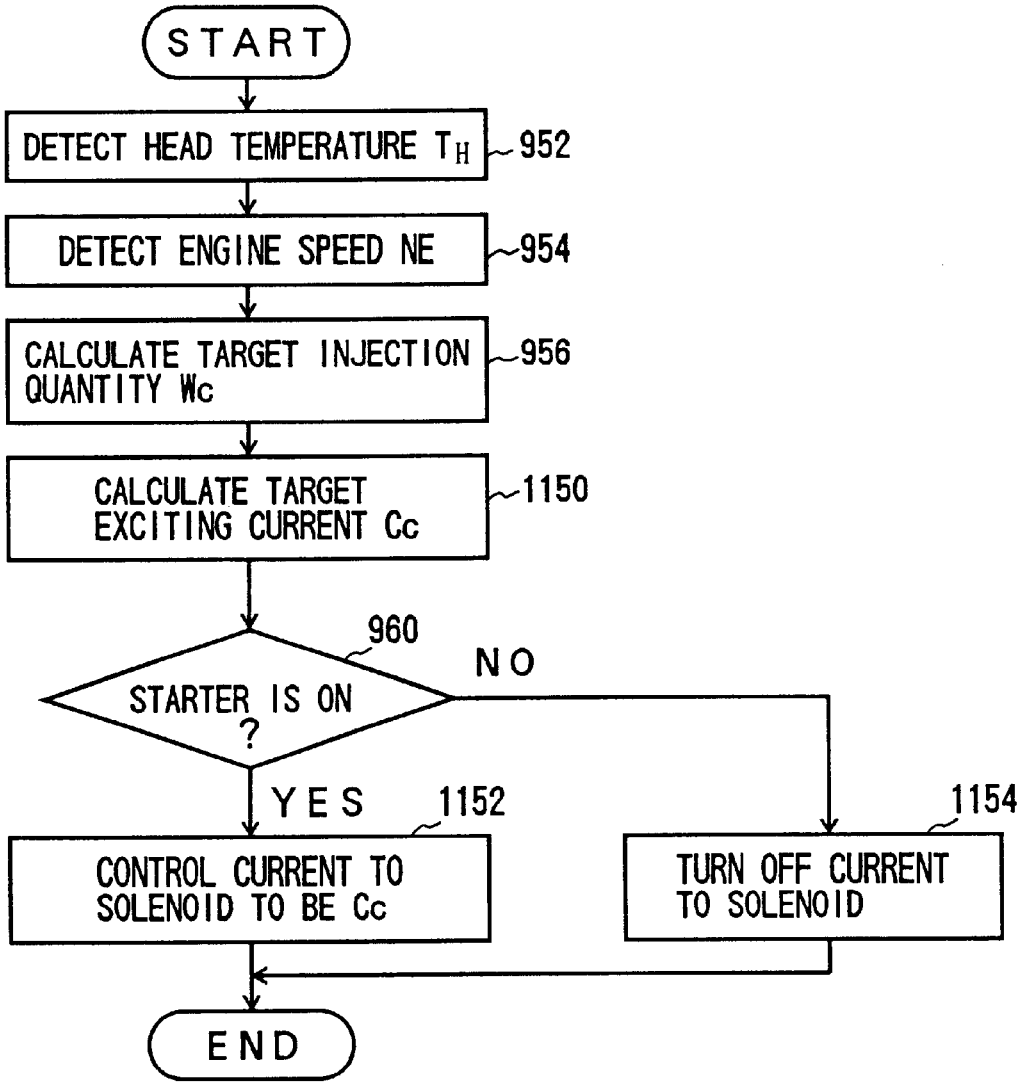
FIG. 19 is a flowchart performed by a controller so as to control an injection quantity when the engine is started in the twelfth embodiment of the present invention.

FIG. 19 shows a flowchart of a control routine performed by the controller 42 so as to control the injection quantity when the engine 10 is started in the present embodiment. The routine shown in FIG. 19 is repeatedly started every time when one process cycle thereof is finished. In FIG. 19, steps in which the same processes are performed as those of steps shown in FIG. 15 are given the same numerals, and descriptions thereof will be omitted.

In the routine shown in FIG. 19, after the target injection quantity $W_c$ is calculated in step 956, a target exciting current $C_c$ to be supplied to the coil 1106 to achieve the target injection quantity $W_c$ is calculated in step 1150. Then, if it is determined that the starter 30 is turned on in step 960, the exciting current supplied to the coil 1106 is controlled to be the target exciting current $C_c$ in step 1152. On the other hand, if it is determined that the starter 30 is not turned on in step 960, the exciting current supplied to the coil 1106 is set to be zero in step 1154. When the process of step 1152 or 1154 is finished, the present routine is ended.

According to the present embodiment, fuel can be injected with a proper injection quantity in accordance with the head temperature $T_H$ and the engine speed NE when the engine 10 is started by the controller 42 performing the above-mentioned routine shown in FIG. 19. Thus, the pilot need not manually adjust the injection quantity by operating the mixture lever 108 or operate the fuel pump switch 916 when the engine 10 is started. Thus, according to the injection quantity control apparatus 1100 of the present embodiment, it is possible to reduce a burden forced on the pilot when the engine 10 is started.

In the above-mentioned twelfth embodiment, the injection quantity is increased by exerting the force $F_e$ on the ball valve 92 in the valve opening direction. However, the solenoid 1104 may be constructed so as to exert forces in both the valve opening direction and the valve closing direction on the ball valve 90 so that the injection quantity can be increased and decreased. For example, when the engine 10 is started immediately after being stopped, a temperature of the engine 10 is relatively high. In such a situation, it may be desired to decrease the injection quantity. In this case, the injection quantity can be decreased by exerting a force on the ball valve 90 in the valve closing direction.

Additionally, in the above-mentioned eleventh embodiment, the injection quantity is controlled by changing a force exerted by the solenoid 1104 on the ball valve 90. However, it is also possible to control the injection quantity by changing a current to the motor 906 in a state where such a large force is exerted on the ball valve 90 that the ball valve 90 is forcibly opened.

Next, a description will be given of a twelfth embodiment of the present invention.

Figure 20:
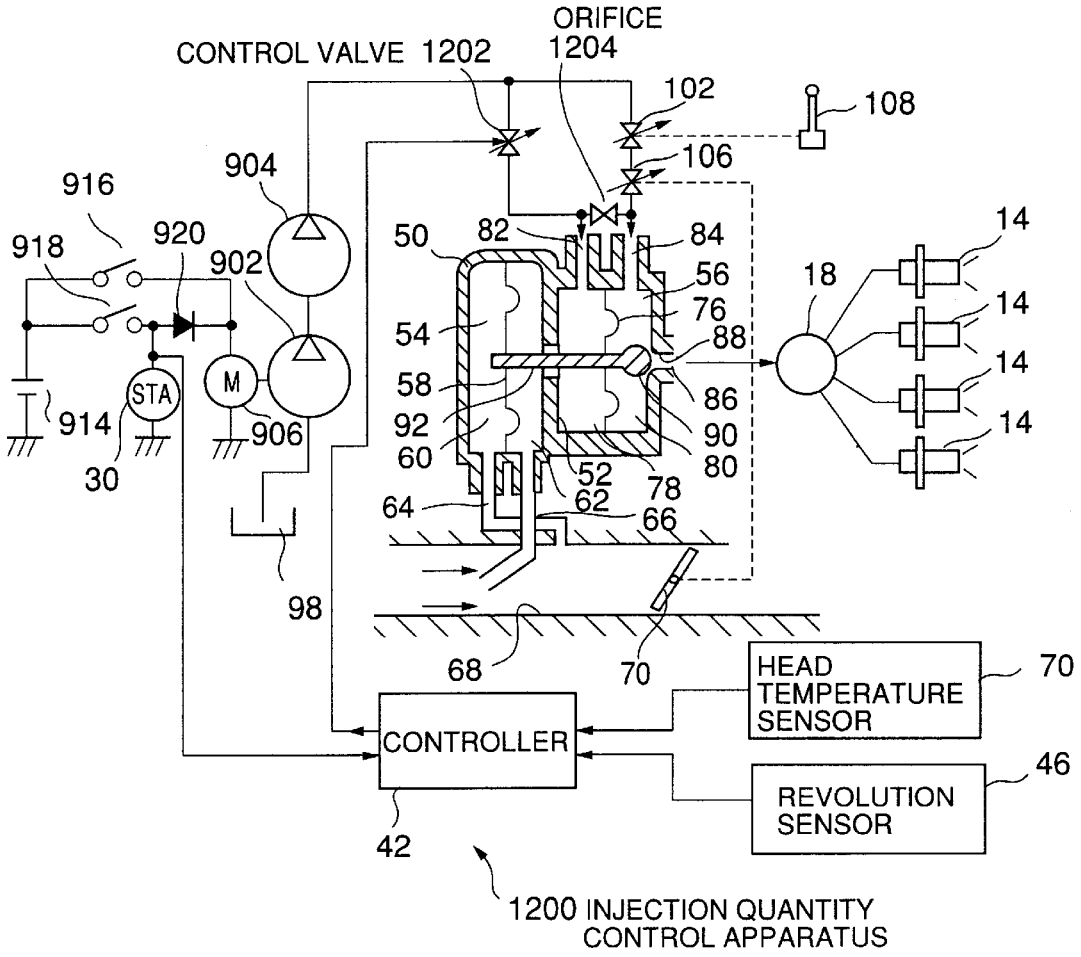
FIG. 20 is a diagram showing a structure of an injection quantity control apparatus of a twelfth embodiment of the present invention.

FIG. 20 is a diagram showing a structure of an injection quantity control apparatus 1200 of the thirteenth embodiment. The injection quantity control apparatus 1200 is achieved by omitting the bypass passage 910, the bypass control valve 912 and the regulator 908, providing a control valve 1202 to a passage connecting the mechanical fuel pump 904 and the back pressure port 82, and connecting the back pressure port 82 and the fuel supply port 84 via an orifice 1204 in the injection quantity control apparatus 900 of the tenth embodiment. The control valve 1202 is a linear control valve which linearly changes an opening thereof in accordance with a control signal supplied from the controller 42.

According to the above-mentioned structure, a pressure of fuel supplied to the back pressure chamber 78 is equal to a differential pressure ($P_P-P_B$) between the supplied fuel pressure $P_P$ and the pressure $P_B$ of the fuel chamber 80 divided by a flow resistance $R_{10}$ and the flow resistance $R_{11}$. That is, the pressure $P_A$ of the back pressure chamber 78 is expressed by the following equation (19).

$$P_A=P_B+(P_P-P_B)\cdot R_{11}/(R_{10}+R_{11}) \tag{19}$$

On the other hand, the pressure of the fuel chamber 80 is expressed by the following equation (20), as mentioned above.

$$P_B=P_P-R\cdot Q \tag{20}$$

From the equations (19) and (20), a differential pressure ΔP2 between the back pressure chamber 78 and the fuel chamber 80 is expressed by the following equation (21).

$$\Delta P_2=\{R_{11}/(R_{10}+R_{11})\}\cdot R\cdot Q \quad (21)$$

The force $F_2$ exerted on the ball valve 90 in the valve closing direction due to the differential pressure ΔP2 is expressed by the following equation (22).

$$F_2=C_2\Delta P_2=C_2\cdot\{R_{11}/(R_{10}+R_{11})\}\cdot R\cdot Q \quad (22)$$

Thus, the force $F_2$ becomes smaller by a value corresponding to the flow resistance $R_{10}$ of the control valve 1202 as compared to a case where the control valve 1202 and the orifice 1204 are not provided. From a balance of the force $F_1$ in the valve opening direction and the force $F_2$ in the valve closing direction, the following equation (23) can be obtained.

$$Q=[\{(R_{10}+R_{11})/R_{11}\}\cdot R\cdot C_1/C_2]\cdot\rho\cdot v^2/2 \quad (23)$$

Thus, according to the present embodiment, it is possible to control the flow rate Q of fuel delivered from the fuel quantity adjustment mechanism 22 by changing the flow resistance $R_{11}$ in accordance with an opening of the control valve 1202. The injection quantity control apparatus 1200 controls the injection quantity by changing the opening of the control valve 1202 in accordance with a control signal supplied to the control valve 1202 from the controller 42.

Figure 21:
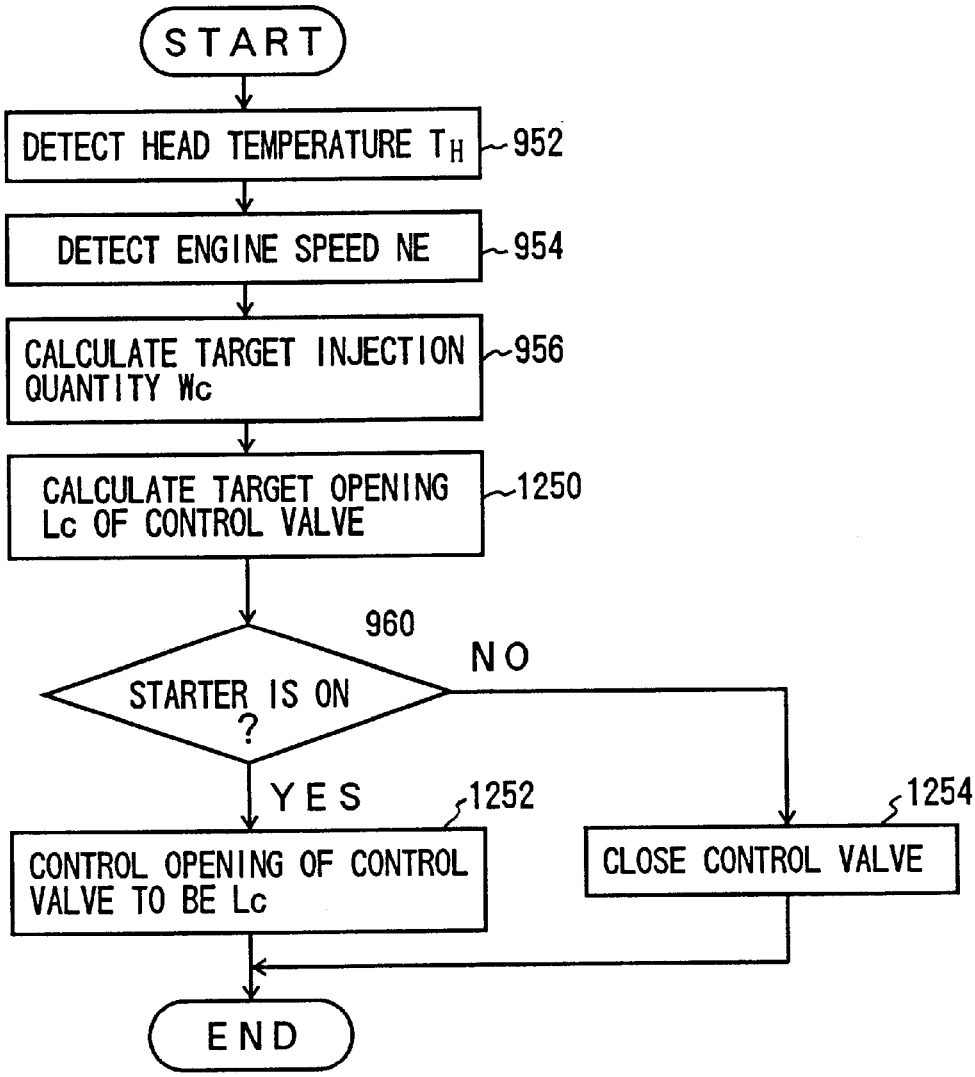
FIG. 21 is a flowchart performed by a controller so as to control an injection quantity when the engine is started in the twelfth embodiment of the present invention.

FIG. 21 shows a flowchart of a control routine performed by the controller 42 so as to control the injection quantity when the engine 10 is started in the present embodiment. The routine shown in FIG. 21 is repeatedly started every time when one process cycle thereof is finished. In FIG. 21, steps in which the same processes are performed as those of steps shown in FIG. 15 are given the same numerals, and descriptions thereof will be omitted.

In the routine shown in FIG. 21, after the target injection quantity $W_c$ is calculated based on the head temperature $T_H$ and the engine speed NE in step 956, the process of step 1250 is performed. In step 1250, a target opening Lc of the control valve 1202 to achieve the target injection quantity $W_c$ is calculated. Then, if it is determined that the starter 30 is turned on in step 960, an opening of the control valve 1202 is controlled to be the target opening Lc in step 1252. On the other hand, if it is determined that the starter 30 is not turned on in step 960, the control valve 1202 is fully opened in step 1254. In this case, the back pressure chamber 78 is supplied with a fuel pressure which is substantially equal to the supplied fuel pressure $P_P$ since the flow resistance $R_{10}$ of the control valve 1202 becomes substantially zero. When the process of step 1252 or 1254 is finished, the present routine is ended.

According to the present embodiment, fuel can be injected with a proper injection quantity in accordance with the head temperature $T_H$ and the engine speed NE when the engine 10 is started by the controller 42 performing the above-mentioned routine shown in FIG. 21. Thus, the pilot need not manually adjust the injection quantity by operating the mixture lever 108 or operate the fuel pump switch 916 when the engine 10 is started. Thus, according to the injection quantity control apparatus 1200 of the present embodiment, it is possible to reduce a burden forced on the pilot when the engine 10 is started.

In the above-mentioned twelfth embodiment, the injection quantity is increased by decreasing the fuel pressure $P_A$ of the back pressure chamber 78 in accordance with an opening of the control valve 1202 so that the force $F_2$ exerted on the ball valve 90 in the valve closing direction is decreased. However, a control valve may be provided in series with the mixture valve 102 and the throttle-linked valve 106 so that the fuel pressure $P_B$ of the fuel chamber 80 can be reduced in accordance with an opening of the control valve. In this case, since the force $F_2$ in the valve closing direction can be increased and decreased, it is possible to increase and decrease the injection quantity.

Additionally, the mixture valve 108 may be constructed so that it can also be electrically actuated. In this case, the injection quantity may be controlled by electrically controlling an opening of the mixture valve 108 when the engine 10 is started.

Next, a description will be given of a thirteenth embodiment of the present invention.

Figure 22:
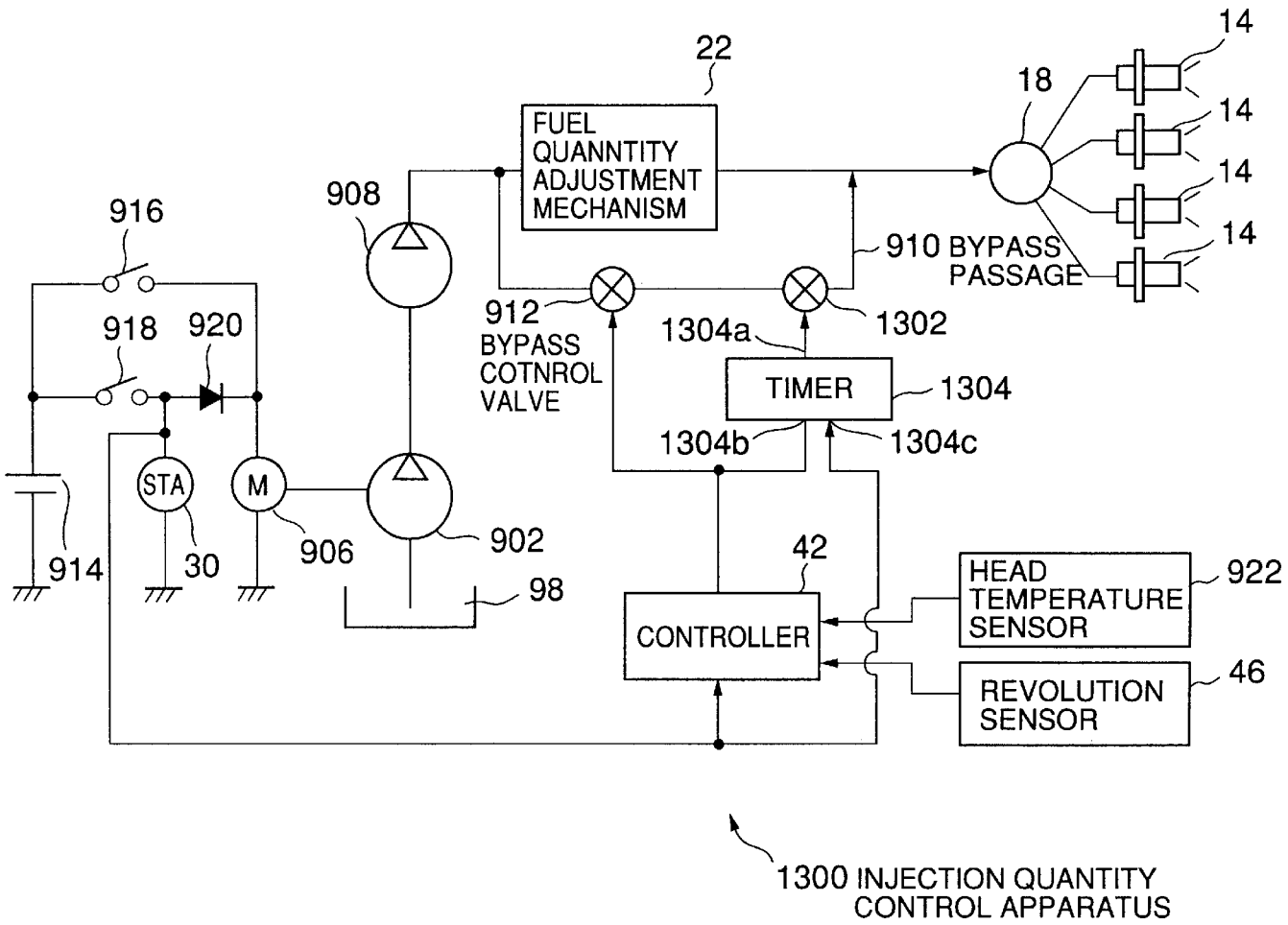
FIG. 22 is a diagram showing a structure of an injection quantity control apparatus of a thirteenth embodiment of the present invention.

FIG. 22 is a diagram showing an injection quantity control apparatus 1300 of the present embodiment. The injection quantity control apparatus 1300 is achieved by additionally providing a second control valve 1302 and a timer 1304 in the injection quantity control apparatus 900 of the tenth embodiment. In FIG. 22, parts that are the same as the parts shown in FIG. 14 are given the same reference numerals, and descriptions thereof will be omitted.

As shown in FIG. 22, the second control valve 1302 is provided to the bypass passage 910 in series with the bypass control valve 912. The second control valve 1302 is an ON/OFF valve which is closed in a regular state and opened when an ON signal is supplied from the timer 1304.

The timer 1304 has an output terminal 1304*a*, an input terminal 1304*b* and a reset terminal 1304*c*. A signal which is supplied to the input terminal 1304*b* of the timer 1304 is directly outputted to the output terminal 1304*a* for a predetermined time Ttimer after an input voltage to the reset terminal 1304*c* has risen, and, after the predetermined time Ttimer has passed, the output signal to the output terminal 1304*a* is turned off. The predetermined time Ttimer is set to be a time for which the injection quantity needs to be controlled (that is, a time for which the starter 30 is expected to be turned on) when the engine 10 is started. The output signal on the output terminal 1304*a* of the timer 1304 is supplied to the second control valve 1302. A control signal which is supplied to the bypass control valve 912 from the controller 42 is also supplied to the input terminal 1304*b*. Additionally, the starter voltage S is supplied to the reset terminal 1304*c*.

In the present embodiment, the controller 42 performs the control routine shown in FIG. 15. When the starter 30 is turned on, the starter voltage S is supplied to the reset terminal 1304*c* of the timer 1304. At the same time, it is affirmatively determined in step 960, and a control signal is supplied to the bypass control valve 912 in accordance with the target opening $A_c$. This control signal is supplied to the second control valve 1302 through the timer 1304 so that the second control valve 1302 is opened for the predetermined time Ttimer. In such a situation, the injection quantity can be controlled in accordance with an opening of the control bypass control valve 912. When the predetermined time Ttimer has passed after the starter 30 is turned on, the second control valve 1302 is closed since the signal supplied to the second control valve 1302 from the timer 1304 is turned off. In a state where the second control valve 1302 is closed, since the bypass passage 910 is shut off, the injection nozzles 14 are supplied with only fuel which is delivered from the fuel quantity adjustment mechanism 22.

As mentioned above, the second control valve 1302 is opened for the predetermined time Ttimer for which the injection quantity needs to be controlled after the starter 30 is turned on. Thus, according to the present embodiment, a proper amount of fuel can be injected in accordance with the head temperature $T_H$ and the engine speed NE without an operation of the mixture lever 108 by the pilot when the engine 10 is started.

Additionally, after the predetermined time Ttimer has passed after the starter 30 is turned on, the bypass passage 910 is positively shut off by the second control valve 1302 being closed. Thus, according to the present embodiment, if the bypass control valve 912 is fixed to be opened or the output signal of the controller 42 is fixed to be an ON state due to a failure, it is possible to prevent the injection quantity from being excessive during a regular operation of the engine since the bypass passage 910 is positively shut off by the second control valve 1302 after the predetermined time Ttimer has passed after the engine 10 is started.

In the above-mentioned thirteenth embodiment, the injection quantity is controlled in accordance with an opening of the bypass control valve 912 when the engine 10 is started. However, the injection quantity may be controlled in accordance with an actuating current supplied to the motor 906 as in the case of the injection quantity control apparatus 1000 of the eleventh embodiment.

Next, a description will be given of a fourteenth embodiment of the present invention.

Figure 23:
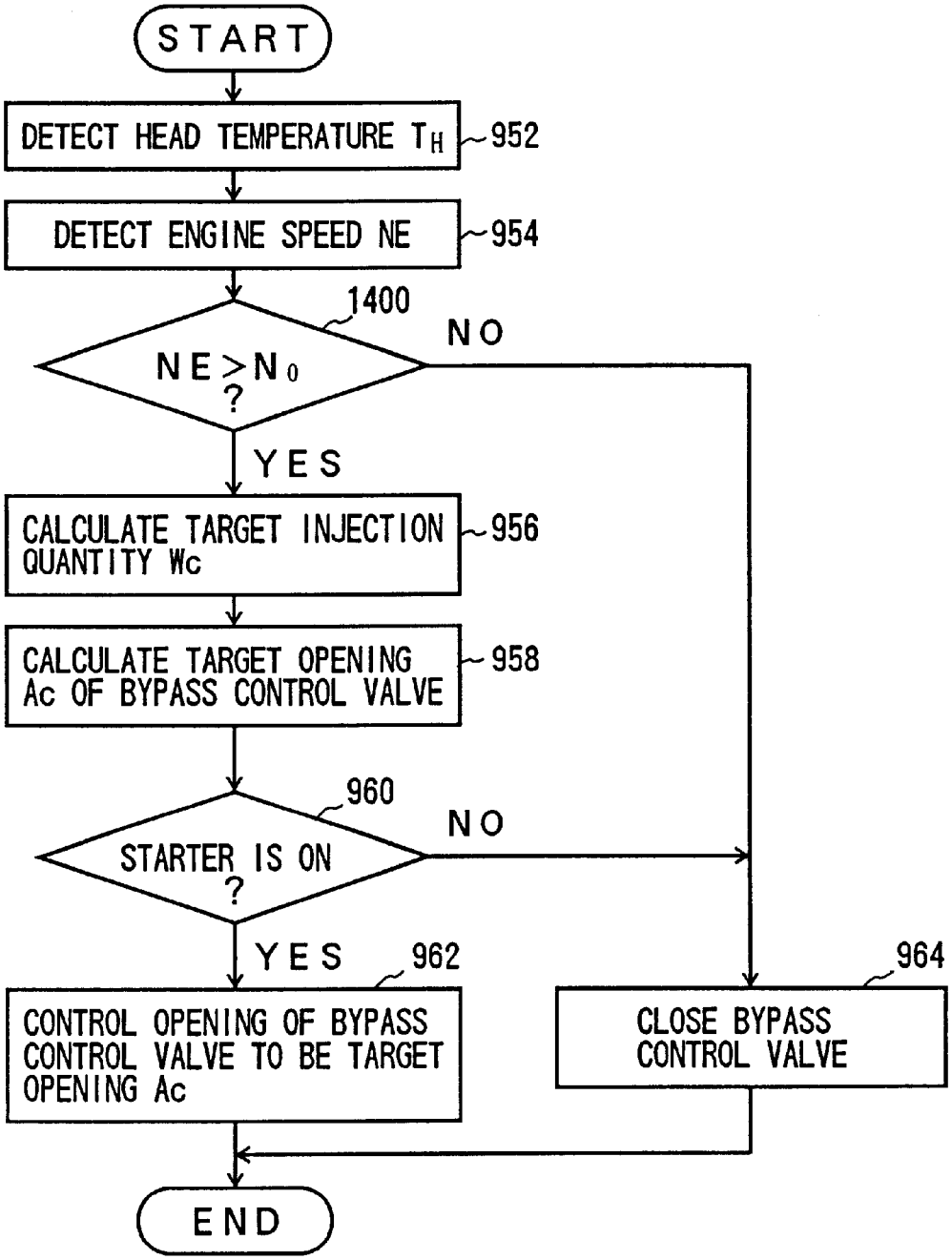
FIG. 23 is a flowchart performed by a controller so as to control an injection quantity when the engine is started in a fourteenth embodiment of the present invention.

An injection quantity control apparatus of the present embodiment is achieved by the controller 42 performing the control routine shown in FIG. 23 in the system shown in FIG. 22. The routine shown in FIG. 23 is repeatedly started every time when one process cycle thereof is finished. In FIG. 23, steps in which the same processes are performed as those of steps shown in FIG. 15 are given the same numerals, and descriptions thereof will be omitted.

In the routine shown in FIG. 23, after the engine speed NE is detected in step 954, the process of step 1400 is performed. In step 1400, it is determined whether or not the engine speed NE is equal to or greater than a predetermined speed $N_0$. The predetermined speed $N_0$ is set to be a sufficiently high value which cannot occur when the engine 10 is being started. Thus, if is determined that $NE \leqq N_0$ is not established in step 1400, it is judged that the engine 10 has been already started. In this case, the bypass control valve 912 is closed in step 964. On the other hand, if it is determined that $NE \leqq N_0$ is established in step 1400, it is judged that the engine 10 has not been started. In this case, the processes of step 956 and the subsequent steps are performed.

According to the above-mentioned routine, the processes of step 956 and the subsequent steps are not performed after the engine 10 has been started. Thus, if the starter voltage S becomes a high level during a regular operation of the engine 10 due to some course, the process of step 962 for increasing the injection quantity is not performed. That is, the injection quantity can be prevented from being unduly increased when the starter voltage S erroneously becomes a high level during a regular operation of the engine 10.

It should be noted that, in the above-mentioned tenth to fourteenth embodiments, it is possible to prevent the injection quantity from being unduly increased due to an occurrence of a high level of starter voltage S by determining whether or not the engine speed NE is greater than or equal to the predetermined value $N_0$ and prohibiting the processes thereafter from being performed if the engine speed NE is greater than or equal to the predetermined value $N_0$.

Additionally, in the tenth to the fifteenth embodiments, the head temperature $T_H$ is used as a value indicating a temperature of the engine 10 which is constructed as an air-cooled engine. However, if the engine 10 is constructed as a water-cooled engine, a temperature of cooling water can be used as a valve indicating a temperature of the engine 10.

The present invention is not limited to these embodiments, but variations and modifications may be made without departing from the scope of the present invention.

The present application is based on Japanese priority applications No. 10-287960 filed on Oct. 9, 1998 and No. 10-286830 filed on Oct. 8, 1998, the entire contents of which are hereby incorporated by reference.

What is claimed is:

1. An injection quantity control apparatus provided to an internal combustion engine having an injection nozzle which continuously injects fuel, the apparatus comprising:

a fuel quantity adjustment mechanism which has a static pressure chamber and a total pressure chamber to which a static pressure and a total pressure of an intake pipe of said engine are supplied, respectively, and adjusts an amount of fuel supplied to said injection nozzle in accordance with a dynamic pressure between a pressure of said static pressure chamber and a pressure of said total pressure chamber; and a dynamic pressure corrector which corrects said dynamic pressure so that an air-fuel ratio of the engine is controlled to be substantially a target value.

2. The injection quantity control apparatus provided to the internal combustion engine as claimed in claim 1, the apparatus further comprising:

an air density compensator which corrects said dynamic pressure in accordance with a density of intake air of the internal combustion engine.

3. The injection quantity control apparatus provided to the internal combustion engine as claimed in claim 1, wherein said dynamic pressure corrector comprises:

a connecting passage which connects a static pressure supply passage for supplying the static pressure to said static pressure chamber and a total pressure supply passage for supplying the total pressure to said total pressure chamber;

a first orifice which is provided to said connecting passage;

a control valve which is provided to said total pressure supply passage or said static pressure supply passage at a position between said connecting passage and said intake pipe; and a valve controller which controls said control valve based on an intake manifold pressure and an engine speed of the engine.

4. The injection quantity control apparatus provided to the internal combustion engine as claimed in claim 3, wherein said dynamic pressure corrector further comprises:

a second orifice provided in parallel with said control valve.

5. The injection quantity control apparatus provided to the internal combustion engine as claimed in claim 4, wherein said first orifice is an air density compensating valve which changes an opening thereof in accordance with a density of intake air of the internal combustion engine.

6. The injection quantity control apparatus provided to the internal combustion engine as claimed in claim 1, wherein said dynamic pressure corrector comprises:

a connecting passage which connects a static pressure supply passage for supplying the static pressure to said static pressure chamber and a total pressure supply passage for supplying the total pressure to said total pressure chamber;

a control valve which is provided to said connecting passage;

a first orifice which is provided to said total pressure supply passage or said static pressure supply passage at a position between said connecting passage and said intake pipe; and a valve controller which controls said control valve based on an intake manifold pressure and an engine speed of the engine.

7. The injection quantity control apparatus provided to the internal combustion engine as claimed in claim 6, wherein said dynamic pressure corrector further comprises:

a second orifice provided to said connecting passage in series with said control valve.

8. The injection quantity control apparatus provided to the internal combustion engine as claimed in claim 7, wherein said first orifice is an air density compensating valve which changes an opening thereof in accordance with a density of intake air of the internal combustion engine.

9. The injection quantity control apparatus provided to the internal combustion engine as claimed in claim 1, wherein said dynamic pressure corrector comprises:

a connecting passage which connects a static pressure supply passage for supplying the static pressure to said static pressure chamber and a total pressure supply passage for supplying the total pressure to said total pressure chamber;

an air density compensating valve which is provided to said connecting passage and changes an opening thereof in accordance with a density of intake air of the internal combustion engine;

an orifice which is provided to said total pressure supply passage or said static pressure supply passage at a position between said connecting passage and said intake pipe;

an opening changing part which changes an opening of said air density compensating valve independent of the density of intake air; and a valve controller which controls said air density control valve by means of said opening changing part so that an air-fuel ratio of the internal combustion engine is substantially equal to a target value.

10. The injection quantity control apparatus provided to the internal combustion engine as claimed in claim 9, wherein said air density compensating valve comprises:

a sealed chamber in which a gas is sealed so that said sealed chamber expands or contracts in accordance with a change in a density of ambient air; and a valve mechanism which changes an opening in accordance with the expansion or contraction of said sealed chamber, wherein said opening changing part comprises a heater which heats said sealed chamber.

11. The injection quantity control apparatus provided to the internal combustion engine as claimed in claim 1, wherein said dynamic pressure corrector comprises:

a connecting passage which connects a static pressure supply passage for supplying the static pressure to said static pressure chamber and a total pressure supply passage for supplying the total pressure to said total pressure chamber;

an orifice which is provided to said connecting passage;

an air density compensating valve which is provided to said total pressure supply passage or said static pressure supply passage at a position between said connecting passage and said intake pipe and changes an opening thereof in accordance with a density of intake air of the internal combustion engine;

an opening changing part which changes an opening of said air density compensating valve independent of the density of intake air; and a valve controller which controls said air density control valve by means of said opening changing part so that an air-fuel ratio of the internal combustion engine is substantially equal to a target value.

12. The injection quantity control apparatus provided to the internal combustion engine as claimed in claim 11, wherein said air density compensating valve comprises:

a sealed chamber in which a gas is sealed so that said sealed chamber expands or contracts in accordance with a change in a density of ambient air; and a valve mechanism which changes an opening in accordance with the expansion or contraction of said sealed chamber, wherein said opening changing part comprises a heater which heats said sealed chamber.

13. The injection quantity control apparatus provided to the internal combustion engine as claimed in claim 1, further comprising:

a start time fuel adjuster which adjusts an amount of fuel supplied to said injection nozzle in accordance with an engine temperature and an engine speed when the internal combustion engine is started.

14. The injection quantity control apparatus provided to the internal combustion engine as claimed in claim 13, wherein said start time fuel adjuster comprises:

a bypass passage which bypasses said fuel quantity adjustment mechanism;

a valve which is provided to said bypass passage; and a valve controller which controls an opening of said valve in accordance with the engine temperature and the engine speed.

15. The injection quantity control apparatus provided to the internal combustion engine as claimed in claim 13, wherein said start time fuel adjuster comprises:

a bypass passage which bypasses said fuel quantity adjustment mechanism; and a pump controller which controls a discharge pressure of a fuel pump which supplies fuel to said fuel quantity adjustment mechanism in accordance with the engine temperature and the engine speed.

16. The injection quantity control apparatus provided to the internal combustion engine as claimed in claim 13, wherein said start time fuel adjuster comprises:

a bypass passage which bypasses said fuel quantity adjustment mechanism;

first and second valves provided to said bypass passage in series with each other;

a valve controller which controls an opening of said first valve based on the engine temperature and the engine speed; and a timer which closes said second valve after a predetermined time has passed after the internal combustion engine is started.

17. The injection quantity control apparatus provided to the internal combustion engine as claimed in claim 13, further comprising:

an adjustment prohibiting part which prohibits said start time fuel adjuster from adjusting an amount of fuel delivered to the injection nozzle when the engine speed is greater than a predetermined value.

* * * * *

UNITED STATES PATENT AND TRADEMARK OFFICE

CERTIFICATE OF CORRECTION

PATENT NO. : 6,247,455 B1 
DATED : June 19, 2001
INVENTOR(S) : Yukio Otake et al.

It is certified that error appears in the above-identified patent and that said Letters Patent is hereby corrected as shown below:

Column 3,
Line 59, delete "resistance D4" and insert -- resistance $D_4$ --;
Line 65, delete "$\Delta P = \Delta P_o \cdot D_4/(D_4+_s)$" and insert -- $\Delta P = \Delta P_o \cdot D_4/(D_4+D_s)$ --;

Column 4,
Line 6, delete "value $\Delta P_o$" and insert -- value $\Delta P_o \cdot$ --;

Line 42, delete "resistance D7" and insert -- resistance $D_7$ --;

Column 14,
Line 7, delete "$C_1P \cdot v^2/2 = C_2 \cdot R \cdot Q+F_m$" and insert -- $C_1 \cdot P \cdot v^2/2 = C_2 \cdot R \cdot Q+F_m$ --;

Column 15,
Line 13, delete "$R_4$ ($R_1 = R_1 \cdot R_4/(R_s+R_4)$)" and insert -- $R_4$ ($R_s = R_1 \cdot R_4/(R_1+R_4)$) --;

Lines 38, 41, and 45, delete "$R_3$" and insert -- $R_s$ --;

Column 17,
Line 17, delete "$R_3$" and insert -- $R_s$ --;

Column 20,
Lines 27 and 28, delete "needle valve 708" and insert -- needle valve 710 --;

Column 21,
Line 17, delete "$P_{II} + P_1$" and insert -- $P_{II} = P_1$ --;

Column 22,
Line 10, delete "temperature to" and insert -- temperature $T_c$ --;
Line 17, delete "$T_c = \alpha \cdot P_a \cdot \delta_c+TO$" and insert -- $T_c = \alpha \cdot P_a \cdot \delta_c+T_a$ --;

Column 27,
Line 23, delete "solenoid 304" and insert -- solenoid 1104 --;
Line 47, delete "$C_1 \cdot V^2/2 + F_e = C_2 \cdot R \cdot Q$" and insert -- $C_1 \cdot P \cdot V^2/2 + F_e = C_2 \cdot R \cdot Q$ --;

UNITED STATES PATENT AND TRADEMARK OFFICE

CERTIFICATE OF CORRECTION

PATENT NO. : 6,247,455 B1
DATED : June 19, 2001
INVENTOR(S) : Yukio Otake et al.

It is certified that error appears in the above-identified patent and that said Letters Patent is hereby corrected as shown below:

Column 29,
Lines 2 and 8, delete "ΔP2" and insert -- $\Delta P_2$ --; and
Line 10, delete "$F_2 = C_2\Delta P_2$" and insert -- $F_2 = C_2 \cdot \Delta P_2$ --.

Signed and Sealed this

Twenty-third Day of March, 2004

JON W. DUDAS
*Acting Director of the United States Patent and Trademark Office*